US012168563B2

(12) United States Patent
Sakai et al.

(10) Patent No.: US 12,168,563 B2
(45) Date of Patent: Dec. 17, 2024

(54) PACKING MEMBER AND CARTRIDGE ASSEMBLY

(71) Applicant: CANON KABUSHIKI KAISHA, Tokyo (JP)

(72) Inventors: Kengo Sakai, Kanagawa (JP); Kazunari Iwai, Kanagawa (JP); Taiji Watanabe, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 18/171,273

(22) Filed: Feb. 17, 2023

(65) Prior Publication Data

US 2023/0264880 A1 Aug. 24, 2023

(30) Foreign Application Priority Data

Feb. 24, 2022 (JP) ..... 2022-026416

(51) Int. Cl.
*B65D 81/02* (2006.01)

(52) U.S. Cl.
CPC ..... *B65D 81/025* (2013.01)

(58) Field of Classification Search
CPC .... B65D 81/025; B65D 81/05; B65D 81/053; B65D 81/127; B65D 81/133; B65D 25/10; B65D 25/107; B65D 5/5069; B65D 5/5071; B65D 81/07
USPC ..... 206/586, 583, 590
See application file for complete search history.

(56) References Cited

U.S. PATENT DOCUMENTS 5,341,934 A * 8/1994 Hsu ..... B65D 81/05 206/521
5,398,808 A * 3/1995 Chen ..... B65D 5/5071 206/320
5,501,339 A * 3/1996 Suzuki ..... B65D 5/5004 206/583
5,755,331 A * 5/1998 Watson ..... B65D 81/05 206/320
5,772,025 A * 6/1998 Chen ..... B65D 81/05 206/320
5,979,659 A * 11/1999 Kataoka ..... B65D 5/5071 206/320
6,268,039 B1 * 7/2001 Chou ..... B65D 5/5069 206/583

(Continued)

FOREIGN PATENT DOCUMENTS

JP H07-232765 9/1995
JP 2003-146376 5/2003

*Primary Examiner* — Steven A. Reynolds
(74) *Attorney, Agent, or Firm* — Venable LLP

(57) ABSTRACT

A packing member includes first and second members. The first member includes a first base surface portion intersecting a first direction and first and second side surface portions that are folded to intersect a second direction from both ends of the first base surface portion, the second member includes a second base surface portion, and third and fourth side surface portions that are folded to intersect a third direction from both ends of the second base surface portion. The third and fourth side surface portions are folded on the same side as the first and second side surface portions. The second member is coupled to the first member so that the first base surface portion is positioned between a third folding line and a tip end of the third side surface portion and positioned between a fourth folding line and a tip end of the fourth side surface portion.

16 Claims, 12 Drawing Sheets

(56) References Cited

U.S. PATENT DOCUMENTS

| | | | | |
|---|---|---|---|---|
| 6,286,330 | B1 * | 9/2001 | Kopf | F25D 17/042 62/314 |
| 6,685,025 | B1 * | 2/2004 | Kari | B65D 5/5069 206/583 |
| 6,843,374 | B1 * | 1/2005 | Li | B65D 5/5069 206/587 |
| 7,021,024 | B2 * | 4/2006 | Kari | B65D 5/5069 493/137 |
| 7,278,249 | B2 * | 10/2007 | Kari | B65D 5/5069 493/137 |
| 2003/0019779 | A1 * | 1/2003 | Horbal | B65B 5/024 206/521 |
| 2006/0021902 | A1 * | 2/2006 | Chen | B65D 81/02 206/586 |
| 2009/0139895 | A1 * | 6/2009 | Li | B65D 5/5069 206/594 |
| 2010/0108702 | A1 * | 5/2010 | Liu | B65D 5/5071 229/87.02 |
| 2017/0144819 | A1 * | 5/2017 | Itano | B65D 81/133 |
| 2018/0273273 | A1 * | 9/2018 | Takeuchi | B65D 81/133 |
| 2022/0297877 | A1 | 9/2022 | Iwai | B65D 5/66 |
| 2022/0380109 | A1 * | 12/2022 | Itano | B65D 85/68 |

* cited by examiner

PACKING MEMBER AND CARTRIDGE ASSEMBLY

BACKGROUND OF THE INVENTION

Field of the Invention

The present invention relates to a packing member used when packing an object to be packed. Here, the packing member is used to protect the object to be packed from external vibration and impact when the object to be packed is transported. An example of an object to be packed is a cartridge for an electrophotographic image forming apparatus (hereinafter referred to as an image forming apparatus). Examples of an image forming apparatus include an electrophotographic copier, an electrophotographic printer (for example, a laser beam printer, an LED printer, and the like), a facsimile machine, a word processor, and the like. Further, a cartridge is configured by integrating constituent members used in an electrophotographic process and is attachable/detachable to/from an apparatus main body of an image forming apparatus. Configuration examples of a cartridge include a cartridge constituted by an electrophotographic photosensitive member as an image bearing member, a cartridge constituted by developing means acting on an electrophotographic photosensitive member, a cartridge constituted by only a developer container, and the like.

DESCRIPTION OF THE RELATED ART

In an image forming apparatus adopting a cartridge system, it is common for a user to remove a cartridge from the main body of the image forming apparatus and replace it with a new cartridge. Here, in order to protect a newly shipped cartridge from vibration and impact during transportation, accommodating the new cartridge in an outer box while it is packed with a packing member formed by bending a plate-shaped packing material is known. For example, there is a corrugated cardboard packing material that covers a cartridge by bending a corrugated cardboard sheet which is a plate-shaped packing material, and various other means as disclosed in in Japanese Patent Application Publication No. H7-232765 and Japanese Patent Application Publication No. 2003-146376 have been proposed as examples of a shape.

SUMMARY OF THE INVENTION

However, configurations disclosed in Japanese Patent Application Publication No. H7-232765 and Japanese Patent Application Publication No. 2003-146376 have the following problems. A portion called a cushioning portion that absorbs vibration and impact by deformation is formed in a packing member, but when the cushioning portion is not formed between an object to be packed and an object applying an impact, it is difficult to obtain sufficient cushioning performance. Further, in the case of a configuration in which a cushioning portion is formed by folding a packing member toward the front side or the back side a plurality of times in order to obtain sufficient cushioning performance, the structure becomes complicated, and it is difficult to perform assembly. Further, in a configuration in which a cushioning portion is formed by many folding operations, the packing member may be disassembled due to vibration and impact.

An object of the present invention is to provide a packing member which has sufficient cushioning performance, has a simple structure, is easy to assemble, and is not disassembled due to vibration or impact.

In order to achieve the above-described object, a packing member for packing an object to be packed in the present invention includes

- a first member and a second member that are constituted by a corrugated cardboard plate,
- wherein the first member includes
  - a first base surface portion that intersects a first direction,
  - a first hole portion that penetrates the first base surface portion,
  - a first side surface portion that is folded with respect to the first base surface portion along a first folding line extending in a third direction intersecting both the first direction and a second direction at one end of the first base surface portion in the second direction intersecting the first direction, and intersects the second direction, and
  - a second side surface portion that is folded on the same side as the first side surface portion with respect to the first base surface portion along a second folding line extending in the third direction at the other end of the first base surface portion in the second direction, and intersects the second direction,
- wherein the second member includes
  - a second base surface portion that intersects the first direction,
  - a second hole portion that penetrates the second base surface portion in the first direction,
  - a third side surface portion that is folded with respect to the second base surface portion along a third folding line extending in the second direction at one end of the second base surface portion in the third direction, and intersects the third direction,
  - a third hole portion that is continuous with the second hole portion and penetrates the third side surface portion,
  - a fourth side surface portion that is folded on the same side as the third side surface portion with respect to the second base surface portion along a fourth folding line extending in the second direction at the other end of the second base surface portion in the third direction, and intersects the third direction, and
  - a fourth hole portion that is continuous with the second hole portion and penetrates the fourth side surface portion in the third direction,
- wherein the third side surface portion of the second member is folded on the same side as the first side surface portion of the first member in the first direction, and
- wherein, in the first direction, the second member is inserted into the first hole portion of the first member so that the first base surface portion is positioned between the third folding line and a tip end of the third side surface portion in the first direction and is positioned between the fourth folding line and a tip end of the fourth side surface portion in the first direction, and the second member is coupled to the first member.

In order to achieve the above-described object, a cartridge assembly in the present invention includes

- a cartridge used in an image forming apparatus; and
- a packing member for packing the cartridge, the packing member including a first member and a second member that are constituted by a corrugated cardboard plate and being attached to the cartridge by inserting the cartridge in a first direction, wherein the first member includes a first base surface portion that intersects the first direction, a first hole portion that penetrates the first base surface portion, a first side surface portion that is folded to face the first direction with respect to the first base surface portion along a first folding line extending in a third direction intersecting both the first direction and a second direction at one end of the first base surface portion in the second direction intersecting the first direction, and intersects the second direction, and a second side surface portion that is folded on the same side as the first side surface portion with respect to the first base surface portion along a second folding line extending in the third direction at the other end of the first base surface portion in the second direction, and intersects the second direction, wherein the second member includes a second base surface portion that intersects the first direction, a second hole portion that penetrates the second base surface portion in the first direction, a third side surface portion that is folded with respect to the second base surface portion along a third folding line extending in the second direction at one end of the second base surface portion in the third direction, and intersects the third direction, a third hole portion that is continuous with the second hole portion and penetrates the third side surface portion, a fourth side surface portion that is folded on the same side as the third side surface portion with respect to the second base surface portion along a fourth folding line extending in the second direction at the other end of the second base surface portion in the third direction, and intersects the third direction, and a fourth hole portion that is continuous with the second hole portion and penetrates the fourth side surface portion in the third direction, wherein the third side surface portion of the second member is folded on the same side as the first side surface portion of the first member in the first direction, wherein, in the first direction, the second member is inserted into the first hole portion of the first member so that the first base surface portion is positioned between the third folding line and a tip end of the third side surface portion in the first direction and is positioned between the fourth folding line and a tip end of the fourth side surface portion in the first direction, and the second member is coupled to the first member, and wherein the first hole portion, the second hole portion, the third hole portion, and the fourth hole portion integrally form a supporting portion into which an end of the cartridge is able to be inserted in the first direction and which is able to support the inserted end of the cartridge.

According to the present invention, it is possible to provide a packing member which has sufficient cushioning performance, has a simple structure, is easy to assemble, and is not disassembled due to vibration or impact.

Further features of the present invention will become apparent from the following description of exemplary embodiments with reference to the attached drawings.

DESCRIPTION OF THE EMBODIMENTS

An embodiment in the present disclosure will be illustratively described in the following examples. However, configurations disclosed in the following examples, such as functions, materials, shapes, and relative arrangements of parts are examples of modes related to the scope of the claims, and the scope of the claims is not limited to the configurations disclosed in these examples. In addition, problems to be solved by the configurations disclosed in the following examples or operations or effects obtained from the disclosed configurations are not intended to limit the scope of the claims.

Example 1

A mode for carrying out the present invention will be exemplarily described in detail below based on an example with reference to the accompanying drawings. Note that dimensions, materials, shapes, and relative arrangements of components described in this embodiment should be appropriately changed in accordance with a configuration of an apparatus to which the invention is applied, and various conditions. That is, it is not intended to limit the scope of the present invention to the following embodiment. Although a plurality of features are described in the embodiment, not all of these plurality of features are essential to the invention, and the plurality of features may be combined arbitrarily.

A packing member according to Example 1 of the present invention will be described with reference to FIG. 1 to FIG. 9. In the following example, a cartridge attachable/detachable to/from an image forming apparatus is exemplified as an object to be packed by a packing member.

Overall Outline of Image Forming Apparatus

Figure 1:
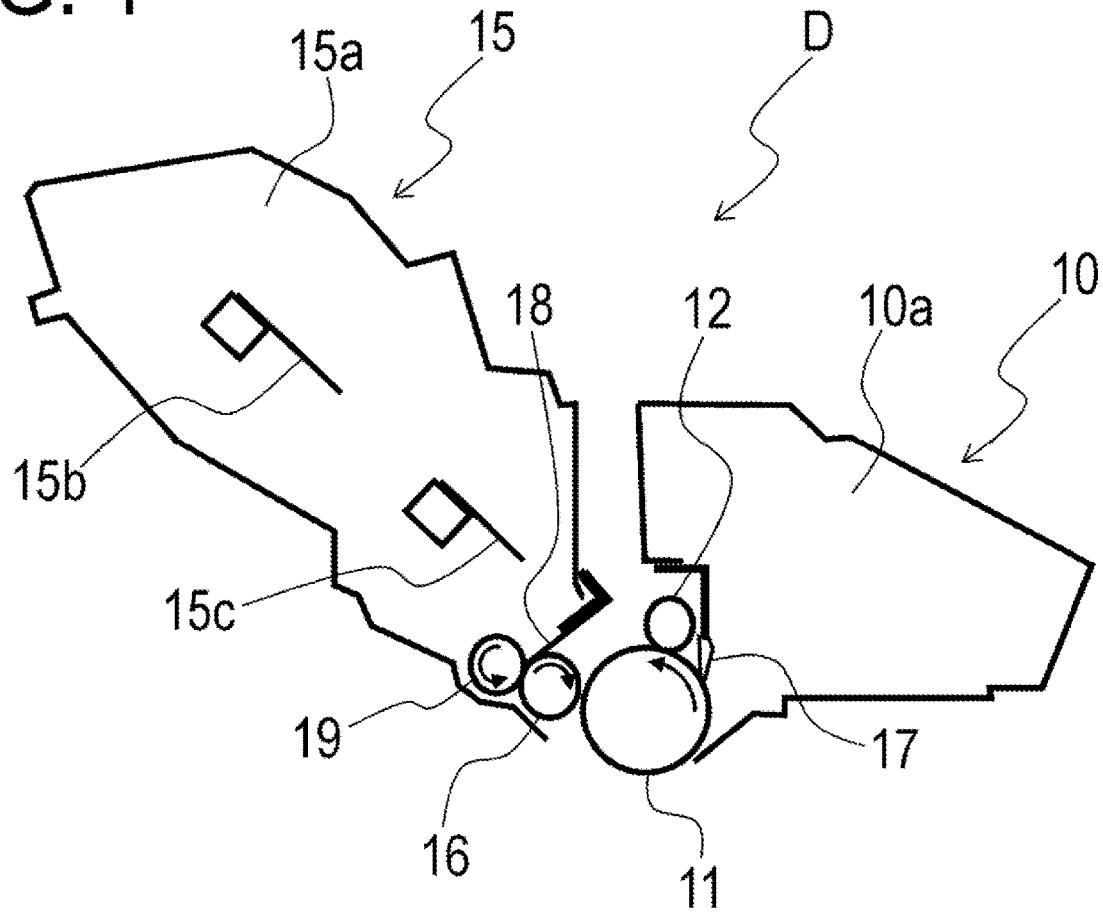
FIG. 1 is a cross-sectional view illustrating a schematic configuration of a process cartridge D.

FIG. 1 is a schematic cross-sectional view illustrating a schematic configuration of a process cartridge D (hereinafter referred to as a cartridge D), which is an example of an object to be packed. The cartridge D includes a cleaning unit 10 (first unit) including a photosensitive drum 11 as an image bearing member, and a developing unit 15 (second unit) including a developing roller 16 as a developer carrier for carrying a developer (toner).

The cleaning unit 10 includes a photosensitive drum 11, a charging roller 12 as a charging member, a cleaning blade 17 as a cleaning member, and a waste toner accommodation portion 10*a*. The charging roller 12 is disposed in contact with the outer peripheral surface of the photosensitive drum 11, and the charging roller 12 charges the photosensitive drum 11 with a voltage applied from the main body of the image forming apparatus which is not illustrated in the drawing. In addition, the charging roller 12 is driven to rotate with the photosensitive drum 11.

The cleaning blade 17 is an elastic member disposed in contact with the outer peripheral surface of the photosensitive drum 11. The tip of the cleaning blade 17 elastically contacts the photosensitive drum 11 to remove a residual toner from the photosensitive drum 11 after a recording material has passed between the photosensitive drum 11 and a transfer roller which is not illustrated in the drawing. The removed toner (waste toner) is accommodated and collected in the waste toner accommodation portion 10*a*.

The developing unit 15 includes a developer accommodation chamber 15*a* that accommodates a toner as a developer. The developing roller 16 rotates forward (opposite to the rotation direction of the photosensitive drum 11) with respect to the photosensitive drum 11, and supplies the toner accommodated in the developer accommodation chamber 15*a* to a developing zone of the photosensitive drum 11. Thereby, an electrostatic latent image formed on the photosensitive drum 11 is developed with a toner. The developing blade 18 abuts on the peripheral surface of the developing roller 16 to regulate the amount of toner adhering to the peripheral surface of the developing roller 16. In addition, triboelectric charges are imparted to the toner. The toner stored in the developer accommodation chamber 15*a* is sent to a region in the developer accommodation chamber 15*a* in which the developing roller 16 is disposed by the rotation of stirring members 15*b* and 15*c*. A supply roller 19 is disposed as a developer supply member to abut on the developing roller 16. The supply roller 19 rotates forward (opposite to the rotation direction of the developing roller 16) with respect to the developing roller 16, carries a toner carried by the stirring members 15*b* and 15*c*, and supplies the toner to the developing roller 16.

Operations of the cartridge D during an image forming operation of the image forming apparatus will be described. The photosensitive drum 11 rotated by a driving source, which is not illustrated in the drawing, is uniformly charged to a predetermined potential by the charging roller 12. After charging, image exposure based on image information is performed on the surface of the photosensitive drum 11 by a laser scanner which is exposure means not illustrated in the drawing, and the charges on the exposed portion are removed to form an electrostatic latent image. A toner is supplied from the developing roller 16 to the electrostatic latent image on the photosensitive drum 11 and visualized on the photosensitive drum 11 as a toner image. On the other hand, in parallel with such a toner image forming operation, a sheet is conveyed along a sheet supply path in the main body of the image forming apparatus as a recording material. The sheet is conveyed between the photosensitive drum 11 and the transfer roller in synchronization with image formation on the photosensitive drum 11. When the sheet passes between the photosensitive drum 11 and the transfer roller, the toner image is transferred from the photosensitive drum 11 as an unfixed image by applying a bias to the transfer roller. Thereafter, the sheet having the toner image transferred thereonto is conveyed to a fixing portion which is not illustrated in the drawing, and the unfixed image is heated and pressurized to be fixed on the surface of the sheet.

The cartridge D is configured such that the relative positions of the cleaning unit 10 and the developing unit 15 can be abutting positions at which the photosensitive drum 11 and the developing roller 16 abut on each other and separation positions at which the photosensitive drum 11 and the developing roller 16 are separated from each other. The cleaning unit 10 and the developing unit 15 are coupled together to be rotatable about a swing center axis parallel to the rotation axes of the photosensitive drum 11 to the developing roller 16. A spring, which is not illustrated in the drawing, is attached between the cleaning unit 10 and the developing unit 15, and the cleaning unit 10 and the developing unit 15 are configured to maintain the abutting positions in a state where no particular external force is applied due to an applied biasing force of the spring. Thus, the cleaning unit 10 and the developing unit 15 can be put in the separation positions by applying a force against the biasing force of the spring. That is, the posture of the cartridge D can be switched between the abutting positions and the separation positions at any timing as required. Thereby, the posture of the cartridge D is set to the separation positions when an image is not being formed, and thus it is possible to suppress deterioration of the photosensitive drum 11, the developing roller 16, and the toner and suppress unnecessary toner consumption when an image is not being formed.

Packing Material

A first corrugated cardboard packing material 200 and a second corrugated cardboard packing material 201 will be described as packing members according to the example of the present invention with reference to FIG. 2 to FIGS. 12A and 12B. Note that the second corrugated cardboard packing material 201 has substantially the same configuration as the first corrugated cardboard packing material 200, the configuration being symmetrical in the longitudinal direction of the cartridge D, which is an object to be packed. Thus, in the following description, the configuration of the first corrugated cardboard packing material 200 will be mainly described, and description of a configuration of the second corrugated cardboard packing material 201 will be omitted.

Figure 3:
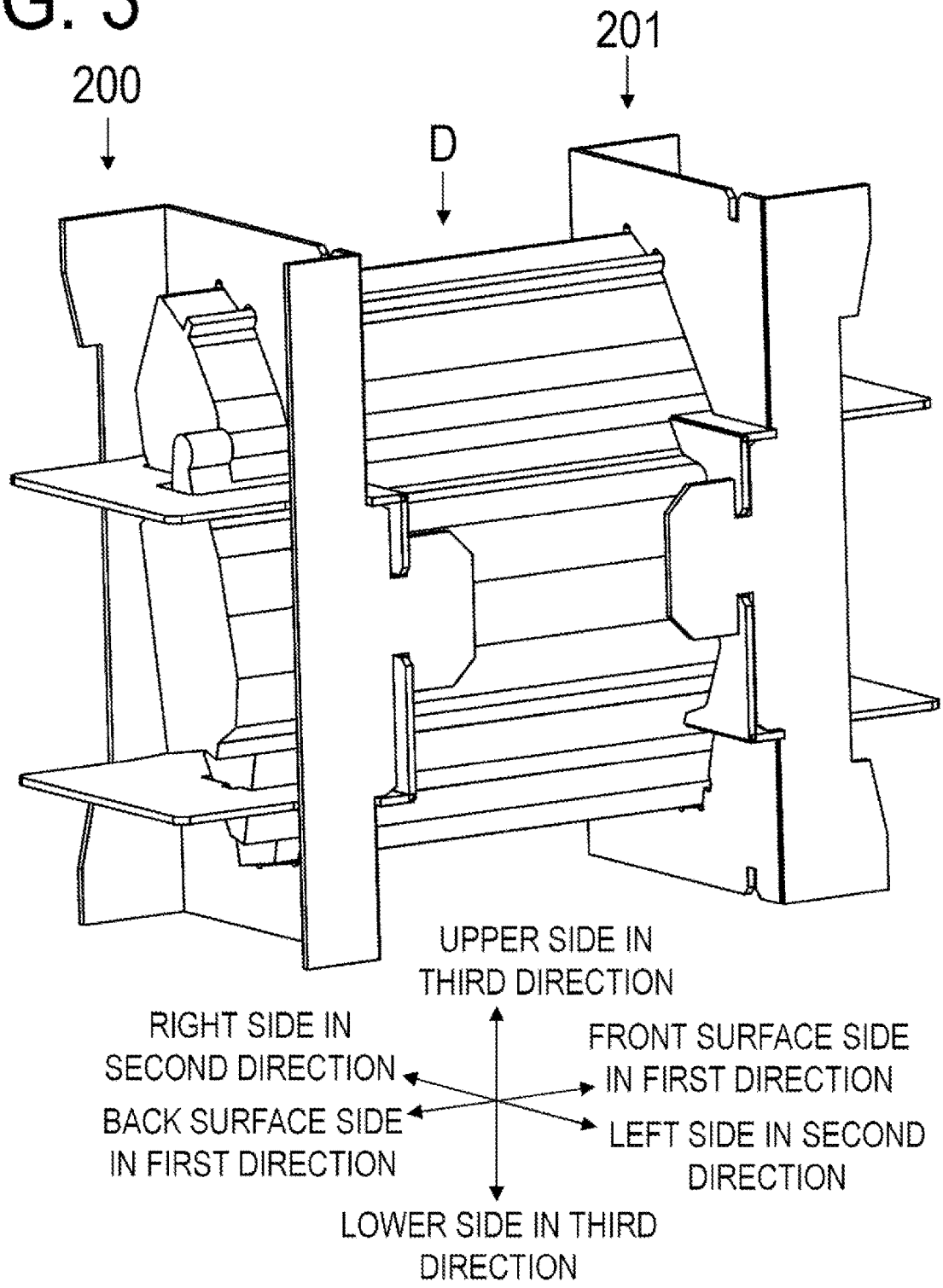
FIG. 3 is a perspective view of a cartridge on which with the first corrugated cardboard packing material and a second corrugated cardboard packing material are mounted.

FIG. 3 is a diagram illustrating a state where the cartridge D is mounted between the first corrugated cardboard packing material 200 and the second corrugated cardboard packing material 201 from opposite directions in order to protect the cartridge D from vibration and impact. The first corrugated cardboard packing material 200 is attached to one end of the cartridge D as an object to be packed in the longitudinal direction (along the rotation axis of the photosensitive drum or the like). The second corrugated cardboard packing material 201 having a configuration longitudinally symmetrical to the configuration of the first corrugated cardboard packing material 200 is attached to the other end portion of the cartridge D in the longitudinal direction. The first corrugated cardboard packing material 200 is attached to one end portion of the cartridge by inserting the cartridge in a first direction along the cartridge longitudinal direction (first direction). Similarly, the second corrugated cardboard packing material 201 is attached to the other end of the cartridge by inserting the cartridge in a second direction opposite to the first direction along the cartridge longitudinal direction (first direction). Note that, in a case where the cartridge D that is an object to be packed is the process cartridge B described above, the photosensitive drum 11 and the developing roller 16 are separated from each other by a separation holding member which is not illustrated in the drawing, and the corrugated cardboard packing material is attached.

Each of the first corrugated cardboard packing material 200 and the second corrugated cardboard packing material 201 has an outline shape that is larger than the outline shape of the cartridge and surrounds the outline of the cartridge when viewed in the longitudinal direction of the cartridge while attached to the cartridge. In addition, the first corrugated cardboard packing material 200 has a part that protrudes in the longitudinal direction beyond one end of the cartridge while attached to the cartridge. Similarly, the second corrugated cardboard packing material 201 also has a part that protrudes in the longitudinal direction beyond the other end of the cartridge while attached to the cartridge. By attaching these two corrugated cardboard packing materials 200 and 201 to both ends of the cartridge, a cartridge protection assembly (cartridge assembly) constituted by the cartridge and the two packing members is configured. The two corrugated cardboard packing materials 200 and 201 protrude from the cartridge in each of three axial directions including the cartridge longitudinal direction (first direction) and two directions perpendicular to the longitudinal direction and perpendicular to each other (second direction and third direction) and protect the cartridge. For example, when the cartridge protection assembly is dropped, at least one of the two corrugated cardboard packing materials 200 and 201 will come into contact with the floor before the cartridge, and thus it is possible to reduce an impact of the drop on the cartridge.

There is a space for a waste toner collection portion 40 and a toner accommodation portion 30*a* inside the longitudinal central portion of the cartridge D. For this reason, the corrugated cardboard packing material is mounted while avoiding the longitudinal central portion of the cartridge D, and thus it is possible to suppress the deformation of the waste toner collection portion 40 and the toner accommodation portion 30*a* due to vibration and impact. In order to protect the cartridge D from dust or the like, the cartridge D may be covered with a bag or a sheet (not illustrated). The bag or sheet may be positioned outside the cartridge D, the first corrugated cardboard packing material 200, and the second corrugated cardboard packing material 201, or may be positioned between the cartridge D and the first and second corrugated cardboard packing materials 200 and 201. That is, an example of a form of the cartridge protection assembly is a form in which corrugated cardboard packing materials are attached to both ends of the cartridge D, and then the cartridge D is wrapped in a sheet such as a resin or paper, or a packing material such as a bag. An example of another form of the cartridge protection assembly is a form in which the cartridge D is wrapped in a sheet such as a resin or paper, or a packing material such as a bag, and then corrugated cardboard packing materials are attached to both ends of the packing material. The cartridge D having the first corrugated cardboard packing material 200 and the second corrugated cardboard packing material 201 mounted thereon is inserted into a corrugated cardboard box (not illustrated). That is, an example of a packaging form of the cartridge is a form in which the cartridge protection assembly is further accommodated in a packaging box such as a corrugated cardboard box.

Configuration of Corrugated Cardboard Packing Material

Figure 2:
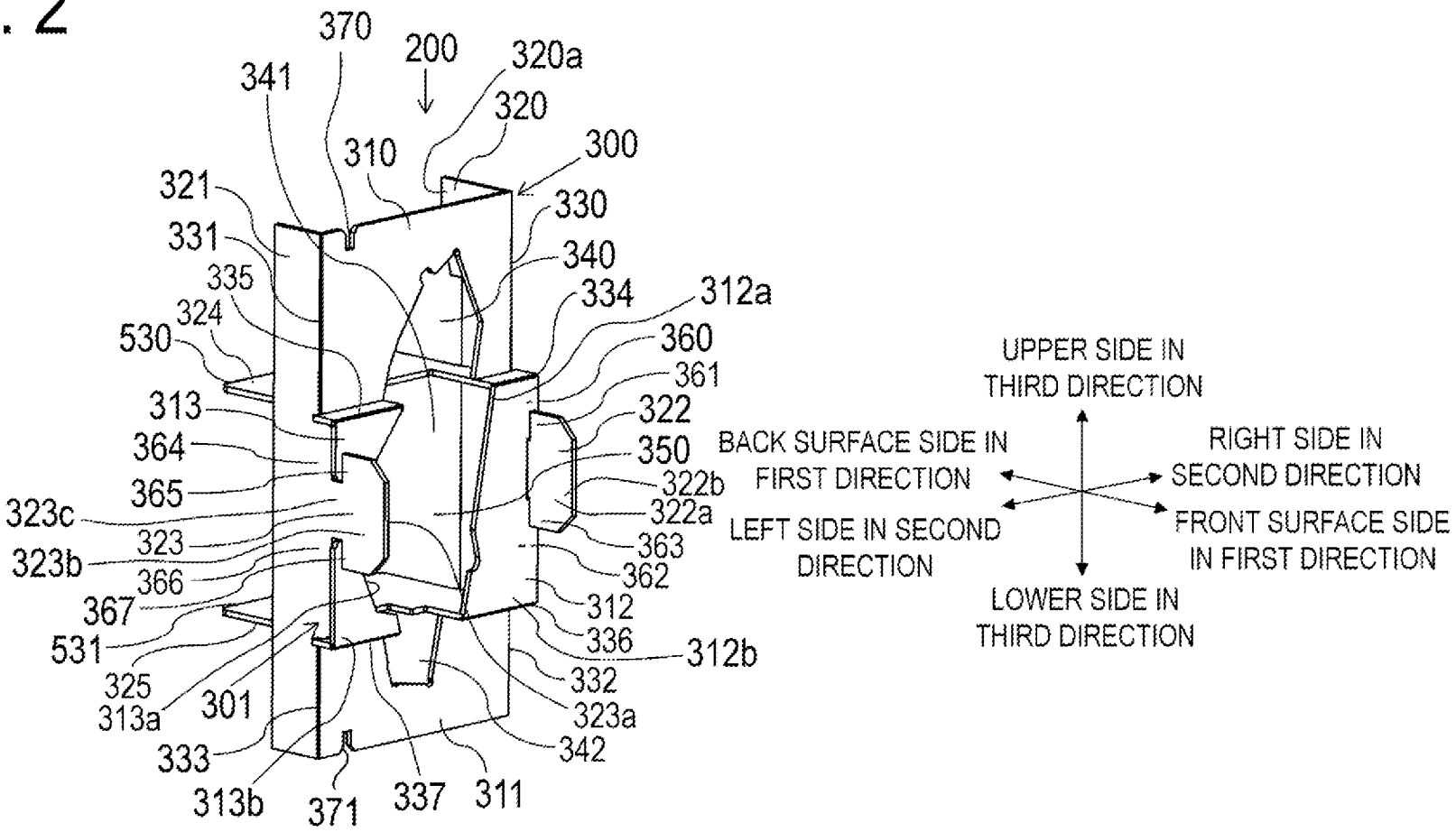
FIG. 2 is a diagram illustrating a first corrugated cardboard packing material after assembly.
Figure 4A:
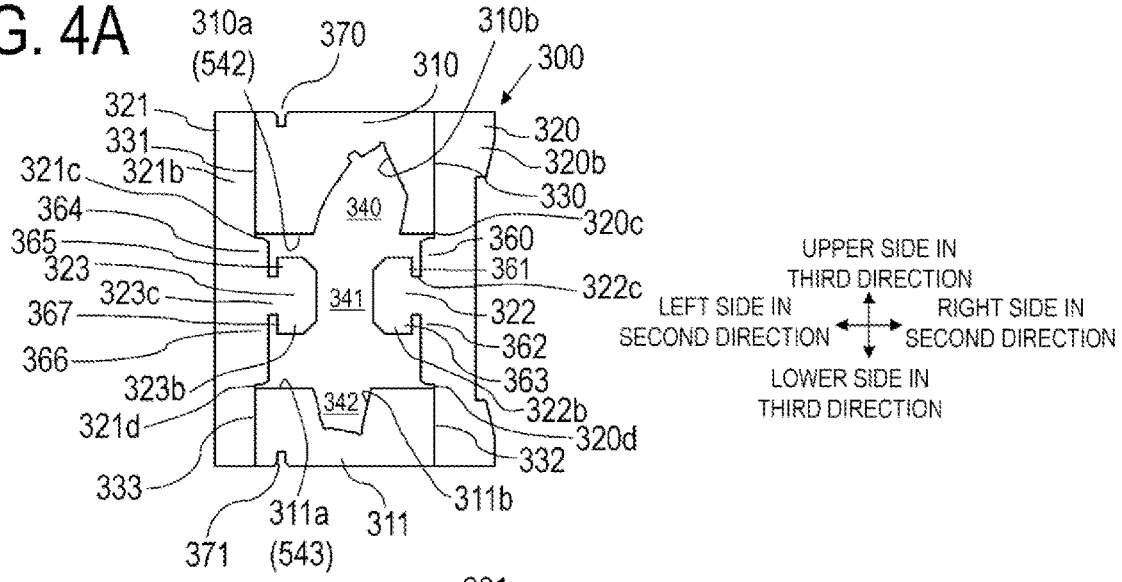
FIGS. 4A and 4B are exploded views of a first member and a second member.
Figure 4B:
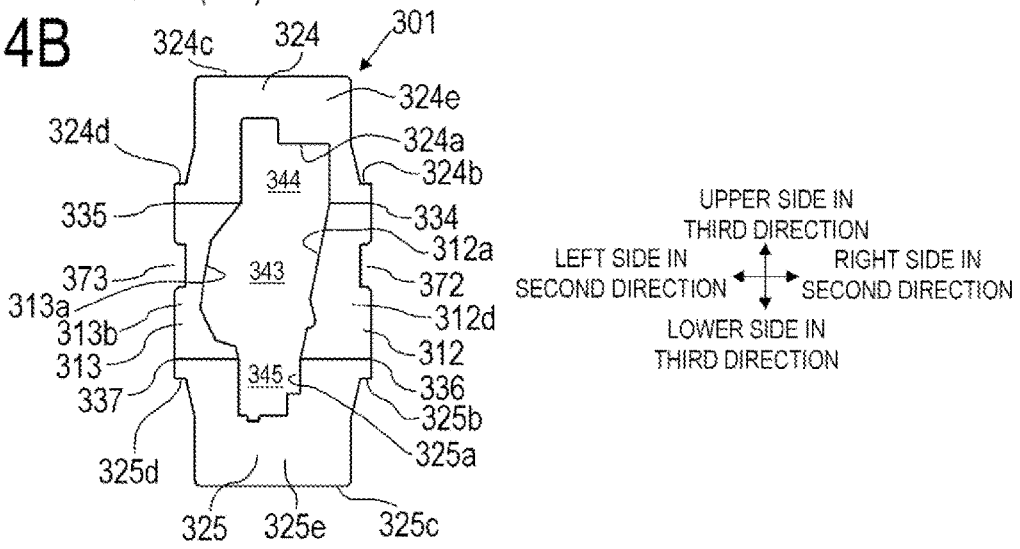
Figure 5A:
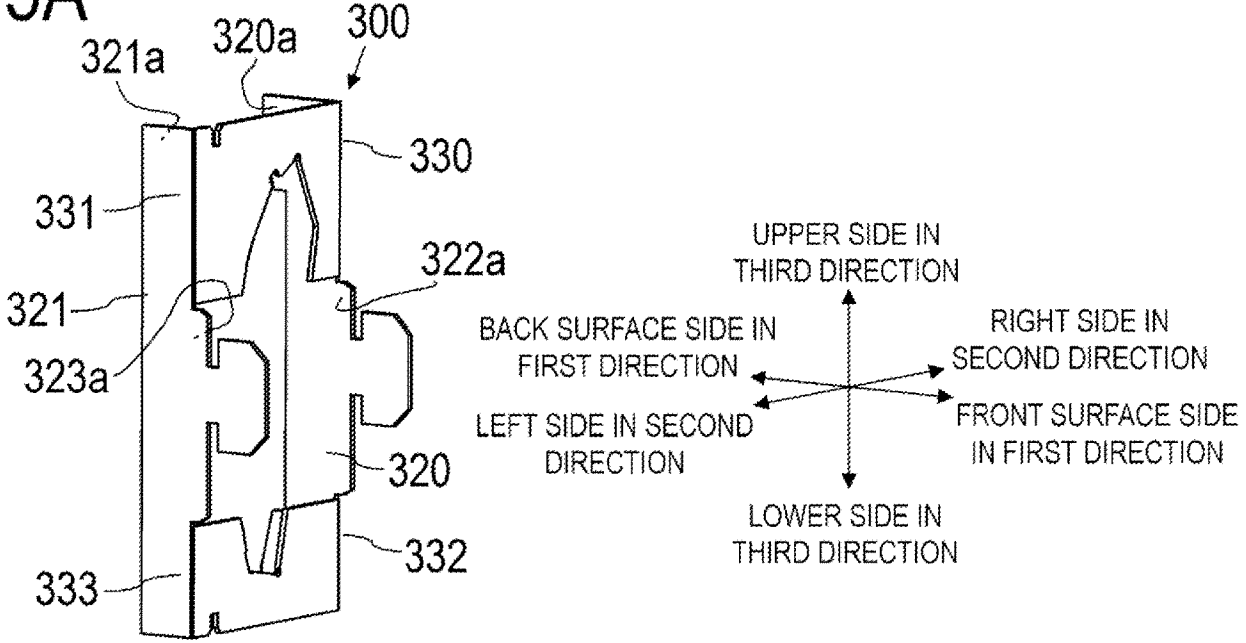
FIGS. 5A and 5B are perspective views illustrating substantially U-shaped states of the first member and the second member.
Figure 5B:
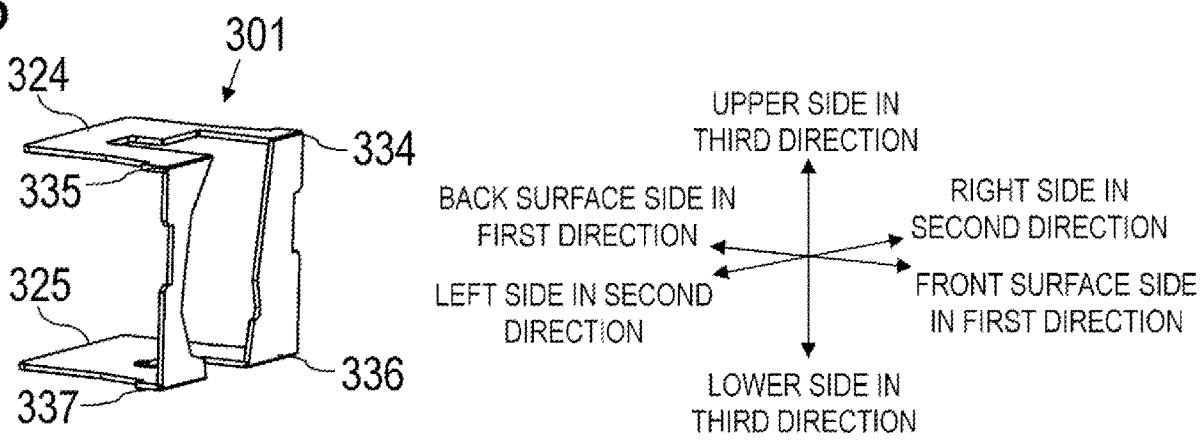
Figure 10A:
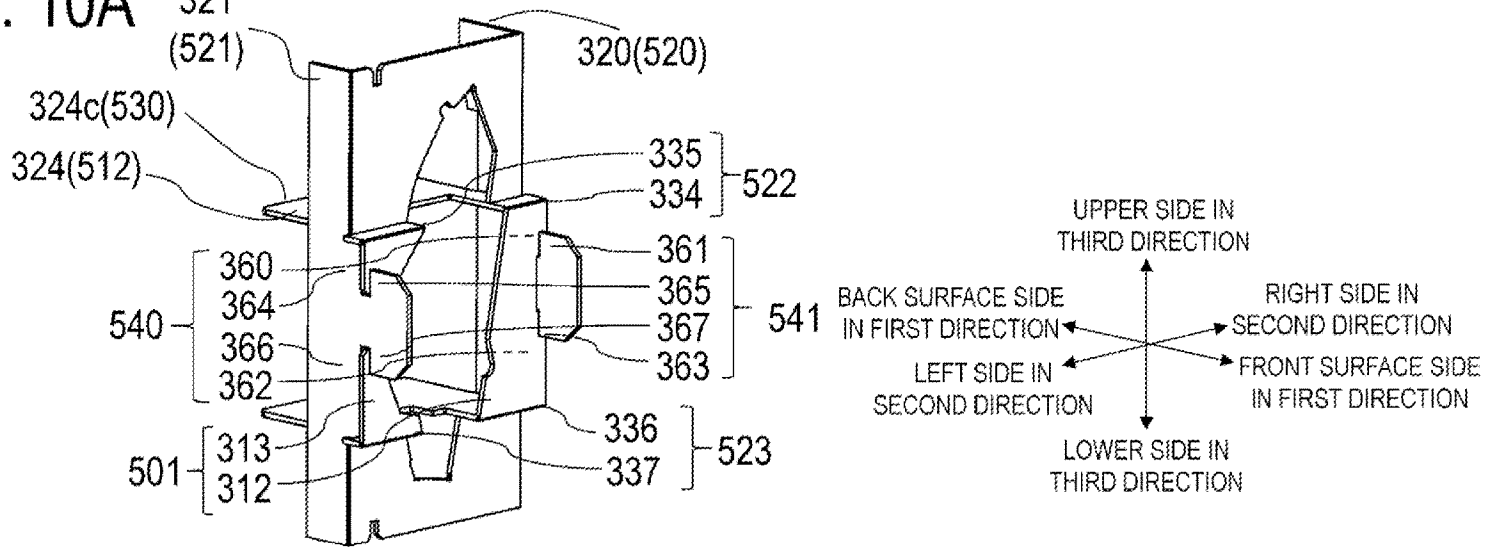
FIGS. 10A and 10B are diagrams illustrating a relationship of the first corrugated cardboard packing material.
Figure 10B:
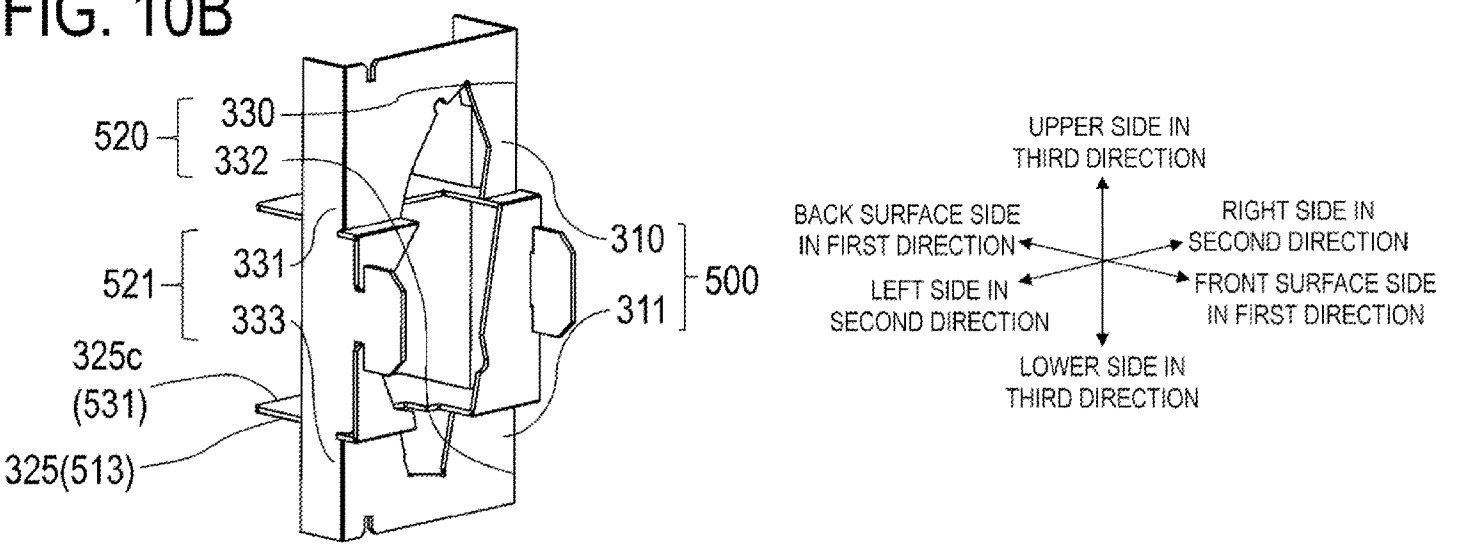

A configuration of the first corrugated cardboard packing material 200 as a packing member according to the example of the present invention will be described with reference to FIG. 2, FIGS. 4A and 4B, FIGS. 5A and 5B, and FIGS. 10A and 10B. FIG. 2 is a schematic perspective view illustrating the first corrugated cardboard packing material 200 after assembly. FIGS. 4A and 4B are exploded views of a first member 300 and a second member 301 that constitute the first corrugated cardboard packing material 200 before being folded. That is, FIG. 4A is an exploded view of the first member 300, and FIG. 4B is an exploded view of the second member 301. FIGS. 5A and 5B are schematic perspective views illustrating a configuration of the first corrugated cardboard packing material 200 before assembly, that is, the respective configurations before the first member 300 and the second member 301 are coupled together. FIG. 5A is a perspective view illustrating a state where the first member 300 is bent into a substantially U-shape, and FIG. 5B is a perspective view illustrating a state where the second member 301 is bent into a substantially U-shape. FIGS. 10A and 10B are schematic perspective views illustrating a relationship between portions of the first corrugated cardboard packing material 200.

The first corrugated cardboard packing material 200 is configured by coupling the first member 300 and the second member 301 together, the first member 300 being a corrugated cardboard structure formed by folding a corrugated cardboard plate, and the second member 301 being a corrugated cardboard structure formed by similarly folding a corrugated cardboard plate. In a state where the first member 300 and the second member 301 are coupled together, an accommodation space 350 into which one end of the cartridge which is an object to be packed can be inserted is formed.

Here, a front surface side in the first direction illustrated in FIG. 2 and subsequent drawings is a side on which the first corrugated cardboard packing material 200 faces the cartridge (a direction facing the cartridge) in the longitudinal direction (first direction) of the cartridge which is an object to be packed. A back surface side in the first direction is a side opposite to the front surface side in the first direction and is a side on which the first corrugated cardboard packing material 200 does not face the cartridge (a direction that does not face the cartridge) in the cartridge longitudinal direction. A right side in the second direction is a rightward direction when viewed in a direction in which an end portion of the cartridge is inserted into the first corrugated cardboard packing material 200 (back surface side in the first direction) in a right-left direction (horizontal direction) perpendicular to the longitudinal direction of the cartridge. A left side in the second direction is a leftward direction when viewed in a direction in which an end portion of the cartridge is inserted into the first corrugated cardboard packing material 200 (back surface side in the first direction) in the right-left direction (horizontal direction) perpendicular to the longitudinal direction of the cartridge. An upper side in the third direction is an upward direction in a vertical direction in the vertical direction (gravity direction) perpendicular to the longitudinal direction of the cartridge. A lower side in the third direction is a downward direction in a vertical direction in the vertical direction (gravity direction) perpendicular to the longitudinal direction of the cartridge.

Note that, regarding the definitions of up, down, left, and right directions of the three axial directions, it is needless to say that the up, down, left, and right directions change depending on a state where the cartridge protection assembly is placed. That is, in a case where the cartridge protection assembly is placed such that the second direction is a direction along the vertical direction, the third direction is a right-left direction (horizontal direction). Further, in a case where the cartridge protection assembly is placed such that the first direction is a direction along the vertical direction, either the second direction or the third direction is a front-back direction, and the other is a right-left direction (horizontal direction).

Further, in the following description, various directions (extending direction, facing direction, penetrating direction, protruding direction, recessed direction, and the like) used at the time of specifying a configuration of each part of the corrugated cardboard packing material are defined by a direction along any one of the three axial directions for convenience. However, the above-described various directions do not necessarily have to be strictly aligned with the above-described three axial directions, and some angular deviations and inclinations of the various directions with respect to the three axial directions are permissible within a range that does not affect the assembly and use of the corrugated cardboard structure. That is, even when the second direction is a cross direction that deviates slightly from a direction perpendicular to the first direction, the corrugated cardboard structure can be assembled and used. Similarly, even when the third direction is a cross direction that deviates slightly from a direction perpendicular to both the first and second directions, the corrugated cardboard structure can be assembled and used. Thus, the corrugated cardboard structure specified by three axial directions including such a permissible range is included in the example of the present invention.

First Member

The first member 300 includes an upper base surface portion 310 and a lower base surface portion 311 that are perpendicular to the first direction, and a first protruding portion 320 and a second protruding portion 321 that are perpendicular to the second direction and protrude from both ends in the second direction of the upper base surface portion 310 and the lower base surface portion 311 to the back surface side in the first direction. The first protruding portion 320 and the second protruding portion 321 are provided to overlap each other when viewed in the second direction. In addition, the first member 300 includes a third protruding portion 322 that protrudes in a direction opposite to the first protruding portion 320 and a fourth protruding portion 323 that protrudes in a direction opposite to the second protruding portion 321. The first member 300 includes an opening portion surrounded by the upper base surface portion 310, the lower base surface portion 311, the first protruding portion 320, the second protruding portion 321, the third protruding portion 322, and the fourth protruding portion 323. The second member 301 is inserted into this opening portion to couple the first member 300 and the second member 301 together.

The upper base surface portion 310 and the lower base surface portion 311, which are first base surface portions 500, respectively have a front surface (first surface) that is perpendicular to the first direction and faces the cartridge, and a back surface (second surface) which is the opposite side. The upper base surface portion 310 and the lower base surface portion 311 are provided to be spaced apart from each other in the third direction. The upper base surface portion 310 is provided on the upper side in the third direction, the lower base surface portion 311 is provided on the lower side in the third direction, and a hole portion is formed between both the base surface portions to penetrate therethrough in the first direction. An end portion of the cartridge D, which is an object to be packed, is inserted into the hole portion in the first direction, and the upper base surface portion 310 and the lower base surface portion 311 forming the hole portion are supported on the cartridge D in a direction perpendicular to the first direction. That is, in the first member 300, the upper base surface portion 310 and the lower base surface portion 311 are mainly portions that reduce an impact on the object to be packed (here, the cartridge D) when the cartridge protection assembly drops.

The upper base surface portion 310 has an edge 310*b*, which is recessed in a concave shape upward in the third direction, at a part of the edge 310*a* on the lower side in the third direction. The edge 310*b* has a shape corresponding to the outline shape of the cartridge D which is an object to be packed, and forms an upper hole portion 340 that constitutes a part of the accommodation space 350. The lower base surface portion 311 has an edge 311*b*, which is recessed downward in the third direction, at a part of an edge 311*a* on the upper side in the third direction. The edge 311*b* has a shape corresponding to the contour shape of the cartridge D, and forms a lower hole portion 342 that constitutes a part of the accommodation space 350. A center hole portion 341 is formed between the upper hole portion 340 and the lower hole portion 342 so as to be surrounded by the edge 310*a* of upper base surface portion 310, the edge 311*a* of lower base surface portion 311, the first protruding portion 320, the second protruding portion 321, the third protruding portion 322, and the fourth protruding portion 323. The second member 301 is inserted into a center hole portion 341. The upper hole portion 340, the center hole portion 341, and the lower hole portion 342 form an integrated hole portion as a first hole portion into which an end portion of the cartridge D as a package is inserted.

In addition, the upper base surface portion 310 includes a first positioning portion 370 for determining the position of the first member 300 when assembling the first member 300 in the apparatus, and the lower base surface portion 311 also includes a second positioning portion 371 exhibiting the same effect as the first positioning portion 370.

The edge 310*a* of the upper base surface portion 310 abuts on the second member 301 downward in the third direction in a state where the first member 300 and the second member 301 are combined. Further, the edge 311*a* of the lower base surface portion 311 abuts on the second member 301 upward in the third direction in a state where the first member 300 and the second member 301 are combined. That is, the first member 300 sandwiches the second member 301 between the edge 310*a* of the upper base surface portion 310 and the edge 311*a* of the lower base surface portion 311 in the third direction.

The first protruding portion 320, which is a first side surface portion 510, is provided to protrude toward the back surface side in the first direction with respect to the upper base surface portion 310 and the lower base surface portion 311 on the right side of the upper base surface portion 310 and the lower base surface portion 311 in the second direction. The first protruding portion 320 is provided on the right side of the upper base surface portion 310 and the lower base surface portion 311 so as to connect the upper base surface portion 310 and the lower base surface portion 311. That is, a part of the first protruding portion 320 on the upper side in the third direction is connected to a right end portion of the upper base surface portion 310 via an upper right folding line 330 extending in the third direction. Further, a part of the first protruding portion 320 on the lower side in the third direction is connected to a right end of the lower base surface portion 311 via a lower right folding line 332 extending in the third direction. The upper right folding line 330 and the lower right folding line 332, which are first folding lines 520, are aligned on the same straight line extending in the third direction. The first protruding portion 320 includes a first inward surface 320*a* which is a surface perpendicular to the second direction and facing the second protruding portion 321, and a first outward surface 320*b* which is a surface on the opposite side.

The second protruding portion 321, which is a second side surface portion 511, is provided to protrude toward the back surface side in the first direction with respect to the upper base surface portion 310 and the lower base surface portion 311 on the left side of the upper base surface portion 310 and the lower base surface portion 311 in the second direction. The second protruding portion 321 is provided on the left side of the upper base surface portion 310 and the lower base surface portion 311 so as to connect the upper base surface portion 310 and the lower base surface portion 311. That is, a part of the second protruding portion 321 on the upper side in the third direction is connected to a left end of the upper base surface portion 310 via an upper left folding line 331 extending in the third direction. A part of the second protruding portion 321 on the lower side in the third direction is connected to a left end of the lower base surface portion 311 via a lower left folding line 333 extending in the third direction. The upper left folding line 331 and the lower left folding line 333, which are second folding lines 521, are aligned on the same straight line extending in the third direction. The second protruding portion 321 includes a second inward surface 321*a* which is a surface perpendicular to the second direction and facing the first protruding portion 320, and a second outward surface 321*b* which is a surface on the opposite side.

The third protruding portion 322 protrudes in a direction opposite to the protruding direction of the first protruding portion 320 in a region between the upper right folding line 330 and the lower right folding line 332 on the front surface side of the first protruding portion 320 in the first direction. The third protruding portion 322 includes a third inward surface 322*a* which is a surface perpendicular to the second direction and continuous with the first inward surface 320*a* of the first protruding portion 320 and faces the fourth protruding portion 323. In addition, the third protruding portion 322 includes a third outward surface 322*b* which is a surface opposite to the third inward surface 322*a* and continuous with the first outward surface 320*b* of the first protruding portion 320.

The fourth protruding portion 323 protrudes in a direction opposite to the protruding direction of the second protruding portion 321 in a region between the upper left folding line 331 and the lower left folding line 333 on the front surface side of the second protruding portion 321 in the first direction. The fourth protruding portion 323 includes a fourth inward surface 323*a* which is a surface perpendicular to the second direction and continuous with the second inward surface 321*a* of the second protruding portion 321 and faces the third protruding portion 322. In addition, the fourth protruding portion 323 includes a fourth outward surface 323*b* which is a surface opposite to the fourth inward surface 323*a* and continuous with the first outward surface 320*b* of the second protruding portion 321.

The third protruding portion 322 and the fourth protruding portion 323 are portions that function as retainers when the first member 300 and the second member 301 are combined. The third protruding portion 322 and the fourth protruding portion 323 protrude to face each other in the second direction so as to sandwich the second member 301 in the second direction. Further, the third protruding portion 322 and the fourth protruding portion 323 respectively include a first regulation portion 540 facing the second member 301 toward the front surface side in the first direction, and a second regulation portion 541 facing the second member 301 toward the back surface side in the first direction. The third protruding portion 322 and the fourth protruding portion 323 sandwich the second member 301 in the first direction between the first regulation portion 540 and the second regulation portion 541.

The third protruding portion 322 includes a constricted portion 322*c* in which the width of the third protruding portion 322 in the third direction is locally narrowed. A first regulation edge 360 as the first regulation portion 540 and a second regulation edge 361 as the second regulation portion 541 are provided to face each other so as to sandwich the second member 301 in the first direction on the upper side of the constricted portion 322*c* in the third direction. In addition, a third regulation edge 362 as the first regulation portion 540 and a fourth regulation edge 363 as the second regulation portion 541 are provided to face each other so as to sandwich the second member 301 in the first direction on the lower side of the constricted portion 322*c* in the third direction.

Similarly, the fourth protruding portion 323 includes a constricted portion 323*c* in which the width of the fourth protruding portion 323 in the third direction is locally narrowed. A fifth regulation edge 364 as the first regulation portion 540 and a sixth regulation edge 365 as the second regulation portion 541 are provided to face each other so as to sandwich the second member 301 in the first direction on the upper side of the constricted portion 323*c* in the third direction. In addition, a seventh regulation edge 366 as the first regulation portion 540 and an eighth regulation edge 367 as the second regulation portion 541 are provided to face each other so as to sandwich the second member 301 in the first direction on the lower side of the constricted portion 323*c* in the third direction.

Second Member

The second member 301 includes a right base surface portion 312 and a left base surface portion 313 that are perpendicular to the first direction, and a fifth protruding portion 324 and a sixth protruding portion 325 that protrude toward the back surface side in the first direction from both ends of the right base surface portion 312 and the left base surface portion 313 in the third direction and are perpendicular to the third direction. The fifth protruding portion 324 and the sixth protruding portion 325 are provided to overlap each other when viewed in the third direction. The second member 301 is coupled to the first member 300 by the fifth protruding portion 324 and the sixth protruding portion 325 being inserted into the center hole portion 341 of the first member 300, the right base surface portion 312 engaging with the third protruding portion 322, and the left base surface portion 313 engaging with the fourth protruding portion 323.

The right base surface portion 312 and the left base surface portion 313, which are second base surface portions 501, respectively have a front surface (third surface) perpendicular to the first direction and facing the cartridge and a back surface (fourth surface) which is a surface on the opposite side. The right base surface portion 312 and the left base surface portion 313 are provided to be separate from each other in the second direction. The right base surface portion 312 is provided on the right side in the second direction, the left base surface portion 313 is provided on the left side in the second direction, and a hole portion is formed between both the base surface portions so as to penetrate therethrough in the first direction. An end of the cartridge D, which is an object to be packed, is inserted into the hole portion in the first direction, and the right base surface portion 312 and the left base surface portion 313 forming the hole portion are portions supported on the cartridge D in a direction perpendicular to the first direction together with the upper base surface portion 310 and the lower base surface portion 311 of the first member 300.

The right base surface portion 312 has an edge 312*a* facing the left base surface portion 313 in the second direction on the left side in the second direction. The edge 312*a* has a shape corresponding to the outline shape of the cartridge D, which is an object to be packed, and constitutes a part of the accommodation space 350. The left base surface portion 313 has an edge 313*a* facing the right base surface portion 312 in the second direction on the right side in the second direction. The edge 313*a* has a shape corresponding to the outline shape of the cartridge, and constitutes a part of the accommodation space 350. That is, a center hole portion 343 having a shape corresponding to the outline shape of the cartridge and penetrating the second member 301 in the first direction is formed between the right base surface portion 312 and the left base surface portion 313.

The right base surface portion 312 has a right positioning portion 372, which is recessed in a concave shape rightward in the second direction, at a part of the edge on the right side in the second direction. The right positioning portion 372 is configured as a receiving portion for the third protruding portion 322 so that the constricted portion 322*c* of the third protruding portion 322 is fitted into the right positioning portion 372 in a state where the first member 300 and the second member 301 are assembled together. The right positioning portion 372 as a first engaging portion abuts on the constricted portion 322*c* as a first engaged portion rightward in the second direction and is configured to be engageable in the third direction.

Similarly, the left base surface portion 313 has a left positioning portion 373, which is recessed in a concave shape rightward in the second direction, at a part of the edge on the left side in the second direction. The left positioning portion 373 is configured as a receiving portion for the fourth protruding portion 323 so that the constricted portion 323*c* of the fourth protruding portion 323 is fitted into the left positioning portion 373 in a state where the first member 300 and the second member 301 are assembled together. The left positioning portion 373 as a second engaging portion abuts on the constricted portion 323*c* as a second engaged portion leftward in the second direction and is configured to be engageable in the third direction.

With the above-described engagement configuration, the third protruding portion 322 abuts on the right base surface portion 312 leftward in the second direction, and the right positioning portion 372 and the constricted portion 322*c* abut on each other so as to regulate mutual movement in the third direction. In addition, the fourth protruding portion 323 abuts on the left base surface portion 313 rightward in the second direction, and the left positioning portion 373 and the constricted portion 323*c* abut on each other so as to regulate mutual movement in the third direction. Thereby, positions in the second direction and the third direction between the right base surface portion 312 and the left base surface portion 313, which are the second base surface portions 501 of the second member 301, and the third protruding portion 322 and the fourth protruding portion 323 of the first member 300 are determined.

Further, as described above, the first regulation portion 540 (the first regulation edge 360, the third regulation edge 362) and the second regulation portion 541 (the second regulation edge 361, the fourth regulation edge 363) of the third protruding portion 322 insert the right base surface portion 312 in the first direction. Similarly, the first regulation portion 540 (the fifth regulation edge 364, the seventh regulation edge 366) and the second regulation portion 541 (the sixth regulation edge 365, the eighth regulation edge 367) of the fourth protruding portion 323 insert the left base surface portion 313 in the first direction. Thereby, positions in the first direction between the right base surface portion 312 and the left base surface portion 313, which are the second base surface portions 501 of the second member 301, and the third protruding portion 322 and the fourth protruding portion 323 of the first member 300 are determined.

The fifth protruding portion 324, which is the third side surface portion 512, is provided above the right base surface portion 312 and the left base surface portion 313 in the third direction so as to protrude toward the back surface side in the first direction with respect to the right base surface portion 312 and the left base surface portion 313. The fifth protruding portion 324 is provided above the right base surface portion 312 and the left base surface portion 313 so as to connect the right base surface portion 312 and the left base surface portion 313. That is, a part of the fifth protruding portion 324 on the right side in the second direction is connected to the upper end portion of the right base surface portion 312 via an upper right folding line 334 extending in the second direction. In addition, a part of the fifth protruding portion 324 on the left side in the second direction is connected to the upper end portion of the left base surface portion 313 via an upper left folding line 335 extending in the second direction. The upper right folding line 334 and the upper left folding line 335, which are third folding lines 522, are aligned on the same straight line extending in the second direction.

The sixth protruding portion 325, which is the fourth side surface portion 513, is provided below the right base surface portion 312 and the left base surface portion 313 in the third direction so as to protrude toward the back surface side in the first direction with respect to the right base surface portion 312 and the left base surface portion 313. The sixth protruding portion 325 is provided below the right base surface portion 312 and the left base surface portion 313 so as to connect the right base surface portion 312 and the left base surface portion 313. That is, a part of the sixth protruding portion 325 on the right side in the second direction is connected to the lower end of the right base surface portion 312 via a lower right folding line 336 extending in the second direction. In addition, a part of the sixth protruding portion 325 on the left side in the second direction is connected to the lower end of the left base surface portion 313 via a lower left folding line 337 extending in the second direction. The lower right folding line 336 and the lower left folding line 337, which are fourth folding lines 523, are aligned on the same straight line extending in the second direction.

The fifth protruding portion 324 is a plate-shaped portion having a downward surface, which is a surface perpendicular to the third direction and facing the sixth protruding portion 325, and an upward surface 324*e* which is a surface on the opposite side. The fifth protruding portion 324 has a tip end portion 324*c* facing the back surface side in the first direction. Similarly, the sixth protruding portion 325 is a plate-shaped portion having an upward surface, which is a surface perpendicular to the third direction and facing the fifth protruding portion 324, and a downward surface 325*e* which is a surface on the opposite side.

The fifth protruding portion 324 has a tip end portion 324*c* as a first tip end portion 530 facing the back surface side in the first direction, and the sixth protruding portion 325 also has a tip end portion 325*c* as a second tip end portion 531 facing the back surface side in the first direction. The tip end portion 324*c* and the tip end portion 325*c* are portions of the cartridge protection assembly which protrude most toward the back surface side in the first direction.

The fifth protruding portion 324 has a shape that is wide in the second direction on the root side near the folding lines 334 and 335, and has an upper right positioning edge 324*b* and an upper left positioning edge 324*d*, which face the back surface side in the first direction, on both sides of the wide portion in the second direction. Similarly, the sixth protruding portion 325 also has a shape that is wide in the second direction on the root side near the folding lines 336 and 337, and has a lower right positioning edge 325*b* and a lower left positioning edge 325*d*, which face the back surface side in the first direction, on both sides of the wide portion in the second direction. On the other hand, the first protruding portion 320 of the first member 300 has an upper right regulation edge 320*c* facing the front surface side in the first direction between the upper right folding line 330 and the third protruding portion 322, and has a lower right regulation edge 320*d* facing the front surface side in the first direction between the third protruding portion 322 and the lower right folding line 332. The second protruding portion 321 of the first member 300 has an upper left regulation edge 321*c* facing the front surface side in the first direction between the upper left folding line 331 and the fourth protruding portion 323, and has a lower left regulation edge 321*d* facing the front surface side in the first direction between the fourth protruding portion 323 and the lower left folding line 333.

When the second member 301 is assembled to the first member 300, the fifth protruding portion 324 and the sixth protruding portion 325 are inserted into the center hole portion 341 of the first member 300 with the tip end portion 324*c* and the tip end portion 325*c* at the head. At this time, the upper right positioning edge 324*b* of the fifth protruding portion 324 abuts on the upper right regulation edge 320*c* of the first protruding portion 320 in the first direction, and the upper left positioning edge 324*d* of the fifth protruding portion 324 abuts on the upper left regulation edge 321*c* of the second protruding portion 321 in the first direction. Similarly, the lower right positioning edge 325*b* of the sixth protruding portion 325 abuts on the lower right regulation edge 320*d* of the first protruding portion 320 in the first direction, and the lower left positioning edge 325*d* of the sixth protruding portion 325 abuts on and the lower left regulation edge 321*d* of the second protruding portion 321 in the first direction. That is, the insertion of the fifth protruding portion 324 and the sixth protruding portion 325 into the center hole portion 341 toward the back surface side in the first direction is regulated. Thereby, positions in the first direction between the fifth protruding portion 324 and the sixth protruding portion 325 of the second member 301 and the first protruding portion 320 and the second protruding portion 321 of the first member 300 are determined.

In addition, the upward surface 324*e* of the fifth protruding portion 324 faces and abuts on the edge 310*a* of the upper base surface portion 310 of the first member 300 upward in the third direction in a state where the first member 300 and the second member 301 are assembled together. Similarly, the downward surface 325*e* of the sixth protruding portion 325 faces and abuts on the edge 311*a* of the lower base surface portion 311 of the first member 300 downward in the third direction in a state where the first member 300 and the second member 301 are assembled together. Thereby, a position in the third direction between the second member 301 and the first member 300 is determined. Positions in the third direction between the fifth protruding portion 324 and the sixth protruding portion 325 of the second member 301 and the first protruding portion 320 and the second protruding portion 321 of the first member 300 are determined.

The fifth protruding portion 324 has an edge 324*a*, which is recessed in a concave shape toward the back surface side in the first direction, on the front surface side in the first direction which is a side facing the cartridge. The edge 324*a* has a shape corresponding to the outline shape of the cartridge, and constitutes a part of the accommodation space 350. That is, a back surface side upper hole portion 344 having a shape corresponding to the outline shape of the cartridge D and penetrating the fifth protruding portion 324 in the third direction is formed on the front surface side of the fifth protruding portion 324 in the first direction. The edge 324*a* forming the back surface side upper hole portion 344 is connected to the upper end portion in the third direction of each of the edges 312*a* and 313*a* forming the center hole portion 343, and the back surface side upper hole portion 344 as a third hole portion forms a hole portion that is continuous with the center hole portion 343 as a second hole portion.

The sixth protruding portion 325 also has an edge 325*a*, which is recessed in a concave shape toward the back surface side in the first direction, on the front surface side in the first direction which is a side facing the cartridge. The edge 325*a* has a shape corresponding to the outline shape of the cartridge and constitutes a part of the accommodation space 350. That is, a back surface side lower hole portion 345 having a shape corresponding to the outline shape of the cartridge D and penetrating the sixth protruding portion 325 in the third direction is formed on the front surface side of the sixth protruding portion 325 in the first direction. The edge 325*a* forming the back surface side lower hole portion 345 is connected to the lower end portion in the third direction of each of the edge 312*a* and the edge 313*a* forming the center hole portion 343, and the back surface side lower hole portion 345 as a fourth hole portion forms a hole portion that is continuous with the center hole portion 343 as the second hole portion.

The upper hole portion 340, the center hole portion 341, and the lower hole portion 342 of the first member 300 which is the first hole portion, and the center hole portion 343, the back surface side upper hole portion 344, and the back surface side lower hole portion 345 of the second member 301 which are second to fourth hole portions form the accommodation space 350 into which the cartridge D can be inserted in the first direction. The upper hole portion 340 and the lower hole portion 342 are formed by the edges 310*b* and 311*b* of the first member 300 as described above, and the center hole portion 343, the back surface side upper hole portion 344, and the back surface side lower hole portion 345 are formed by the edges 312*a*, 313*a*, 324*a*, and 325*a* of the second member 301. The edges 310*b* and 311*b* of the first member 300 and the edges 312*a*, 313*a*, 324*a*, and 325*a* of the second member 301 integrally form a supporting portion capable of supporting the edge of the cartridge D inserted into the accommodation space 350.

The edges 324*a* and 325*a* of the second member 301 face the end portions of the cartridge D inserted into the accommodation space 350, respectively, in the first direction. The edges 310*b* and 311*b* of the first member 300 and the edges 312*a*, 313*a*, 324*a*, and 325*a* of the second member 301 face the end portions of the cartridge D inserted into the accommodation space 350, respectively, in the second direction. In addition, the edges 310*b* and 311*b* of the first member 300 and the edges 312*a* and 313*a* of the second member 301 face the end portions of the cartridge D inserted into the accommodation space 350, respectively, in the third direction. Due to the facing structure in the three axial directions described above, the mounting position of the cartridge D on the first corrugated cardboard packing material 200 is regulated in each of the three axial directions.

Assembly of Corrugated Cardboard Packing Material

Figure 6A:
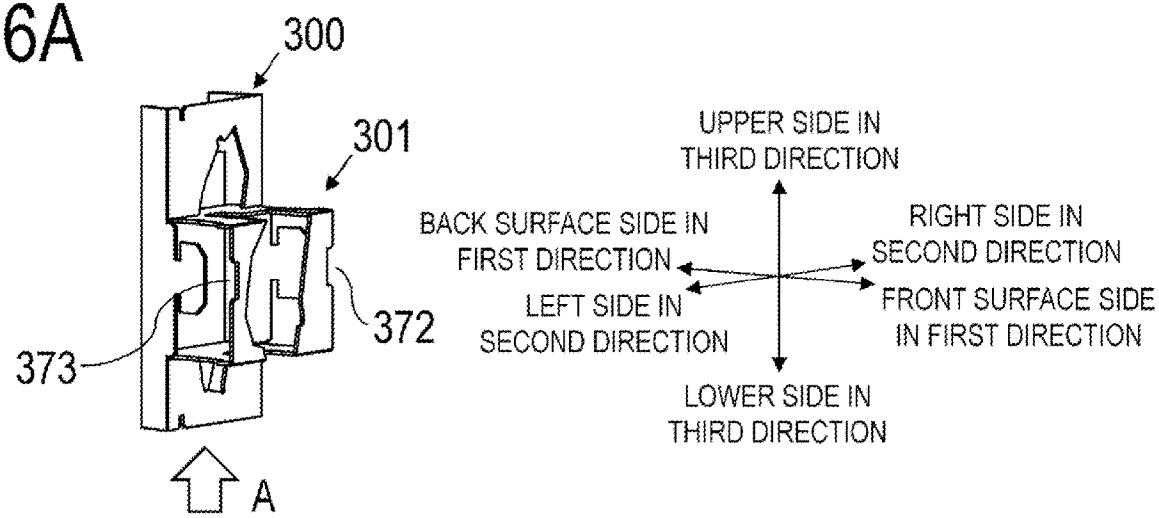
FIGS. 6A and 6B are perspective views illustrating a state where the first member and the second member are being assembled.
Figure 6B:
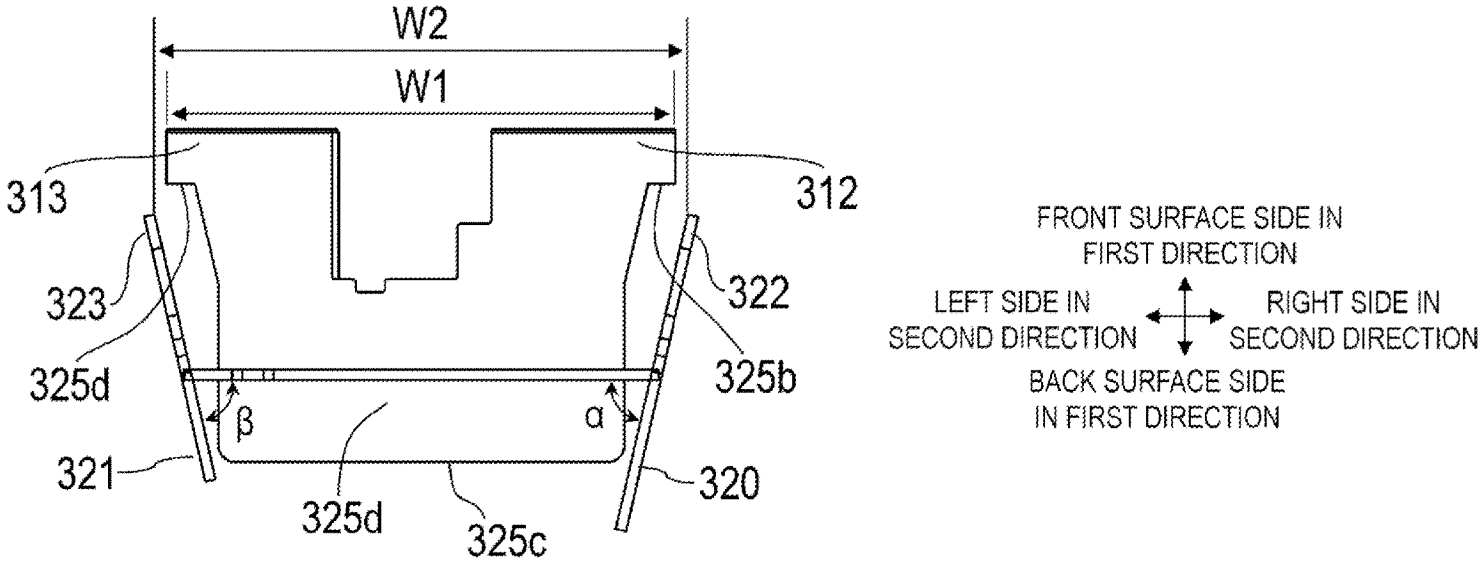

Assembly of the first corrugated cardboard packing material 200 will be described with reference to FIG. 2, FIGS. 4A and 4B, FIGS. 5A and 5B, FIGS. 6A and 6B, and FIGS. 10A and 10B. FIG. 6A is a perspective view when the first member 300 and the second member 301 that are bent into a substantially U-shape are assembled together, and FIG. 6B is a diagram when view from A in FIG. 6A.

In the first member 300, the first protruding portion 320 is bent along the first folding lines 520 (the folding lines 330 and 332) with respect to the first base surface portions 500, and the second protruding portion 321 is bent along the second folding lines 521 (the folding lines 331 and 333) from the flat plate-shaped state illustrated in FIG. 4A. As illustrated in FIG. 4A, before bending, the first protruding portion 320 extends rightward in the second direction, and the second protruding portion 321 extends leftward in the second direction. From this state, the first member 300 is bent so that the first protruding portion 320 and the second protruding portion 321 extend toward the back surface side in the first direction. Thereby, the first member 300 becomes a substantially U-shaped structure illustrated in FIG. 5A.

The third protruding portion 322 is provided on a side opposite to the first protruding portion 320 with the first folding line 520 interposed therebetween, and the fourth protruding portion 323 is provided on a side opposite to the second protruding portion 321 with the second folding line 521 interposed therebetween. Thus, a direction in which the third protruding portion 322 and the fourth protruding portion 323 extend also changes by the bending of the first protruding portion 320 and the second protruding portion 321 described above. That is, as illustrated in FIG. 4A, before bending, the third protruding portion 322 extends leftward in the second direction, and the fourth protruding portion 323 extends rightward in the second direction. From this state, the third protruding portion 322 and the fourth protruding portion 323 extend toward the back surface side in the first direction as illustrated in FIG. 5A by the bending of the first protruding portion 320 and the second protruding portion 321 described above.

Also in the second member 301, the fifth protruding portion 324 is bent along the third folding lines 522 (the folding lines 334 and 335) with respect to the second base surface portion 501, and the sixth protruding portion 325 is bent along the fourth folding lines 523 (the folding lines 336 and 337) from the flat plate-shaped state illustrated in FIG. 4B. As illustrated in FIG. 4B, before bending, the fifth protruding portion 324 extends upward in the third direction, and the sixth protruding portion 325 extends downward in the third direction. From this state, the first member 300 is bent such that the fifth protruding portion 324 and the sixth protruding portion 325 extend toward the back surface side in the first direction. Thereby, the second member 301 becomes a substantially U-shaped structure illustrated in FIG. 5B.

The first protruding portion 320 and the second protruding portion 321 are bent toward the back surface side in the same first direction with respect to the upper base surface portion 310 and the lower base surface portion 311 that are the first base surface portions 500. Similarly, the fifth protruding portion 324 and the sixth protruding portion 325 are bent toward the back surface side in the same first direction with respect to the right base surface portion 312 and the left base surface portion 313 that are the second base surface portions 501. That is, the first protruding portion 320, the second protruding portion 321, the fifth protruding portion 324, and the sixth protruding portion 325 each change from a state where the portions extend in the second direction to a state where the portions extend toward the back surface side in the first direction, and the bending directions thereof are unified. Thus, when bending and assembling of the first member 300 and the second member 301 are performed using an assembling apparatus, the first member 300 and the second member 301 can be folded into a substantially U-shape at the same time by one bending. For this reason, both the members can be assembled in the state of their substantially U-shapes, and thus it is possible to easily perform the assembling using the assembling apparatus.

As illustrated in FIG. 6A, when the first member 300 and the second member 301 are assembled together, the second member 301 is relatively inserted into (the center hole portion 341 of) the first member 300 in the first direction. At this time, as illustrated in FIG. 6B, bending angles $\alpha$ and $\beta$ of the first protruding portion 320 and the second protruding portion 321 are adjusted such that a distance W2 between the third protruding portion 322 and the fourth protruding portion 323 is larger than a distance W1 between the right end of the right base surface portion 312 and the left end of the left base surface portion 313. In a state where the distance W2 is larger than the distance W1, the second member 301 is inserted into the center hole portion 341 of the first member 300, and the bending angles $\alpha$ and $\beta$ of the first protruding portion 320 and the second protruding portion 321 are returned to approximately 90 degrees. In this manner, the third protruding portion 322 is fitted to the right positioning portion 372 of the right base surface portion 312, and the fourth protruding portion 323 is fitted to the left positioning portion 373 of the left base surface portion 313.

As illustrated in FIG. 2, the fifth protruding portion 324 is inserted into the center hole portion 341 of the first member 300 so as to extend from the front surface side to the back surface side in the first direction with respect to the upper base surface portion 310 as an upper bail on the lower side of the upper base surface portion 310 in the third direction. Thus, the edge 310*a* of the upper base surface portion 310 on the lower side in the third direction, which is the third regulation portion 542, presses the surface (upward surface 324*e*) of the fifth protruding portion 324 downward in the third direction, and thus the fifth protruding portion 324 is prevented from opening upward in the third direction. Similarly, the sixth protruding portion 325 is inserted into the center hole portion 341 of the first member 300 so as to extend from the front surface side to the back surface side in the first direction with respect to the lower base surface portion 311 on the upper side of the lower base surface portion 311 in the third direction. Thus, the edge 311*a* of the lower base surface portion 311 on the upper side in the third direction, which is the fourth regulation portion 543, presses the surface (downward surface 325*e*) of the sixth protruding portion 325 upward in the third direction, and thus the sixth protruding portion 325 is prevented from opening downward in the third direction.

In addition, the third protruding portion 322 engages with the right positioning portion 372 of the right base surface portion 312, and the fourth protruding portion 323 engages with the left positioning portion 373 of the left base surface portion 313. For this reason, the upper portion of the right base surface portion 312 in the third direction is inserted between the first regulation edge 360 and the second regulation edge 361, and the lower portion of the base surface portion 312 in the third direction is inserted between the third regulation edge 362 and the fourth regulation edge 363. In addition, the upper portion of the left base surface portion 313 in the third direction is inserted between the fifth regulation edge 364 and the sixth regulation edge 365, and the lower portion of the left base surface portion 313 in the third direction is inserted between the seventh regulation edge 366 and the eighth regulation edge 367. Thereby, the first corrugated cardboard packing material 200 is prevented from being disassembled due to vibration or impact.

In the first corrugated cardboard packing material 200 mounted on the cartridge D, the edge of the first member 300 and the edge of the second member 301 which come into contact with the cartridge D are the cross-section of a corrugated cardboard. That is, the first corrugated cardboard packing material 200 absorbs vibration and impact during transportation by deformation of the corrugated cardboard in a direction in which the cross-section of the corrugated cardboard is pressed perpendicularly to the cross-section. Since the strength of the corrugated cardboard in the direction in which the cross-section is pressed is higher than the strength in the direction in which a sheet surface of the corrugated cardboard is pressed, it is possible to absorb greater vibration and impact.

Figure 11A:
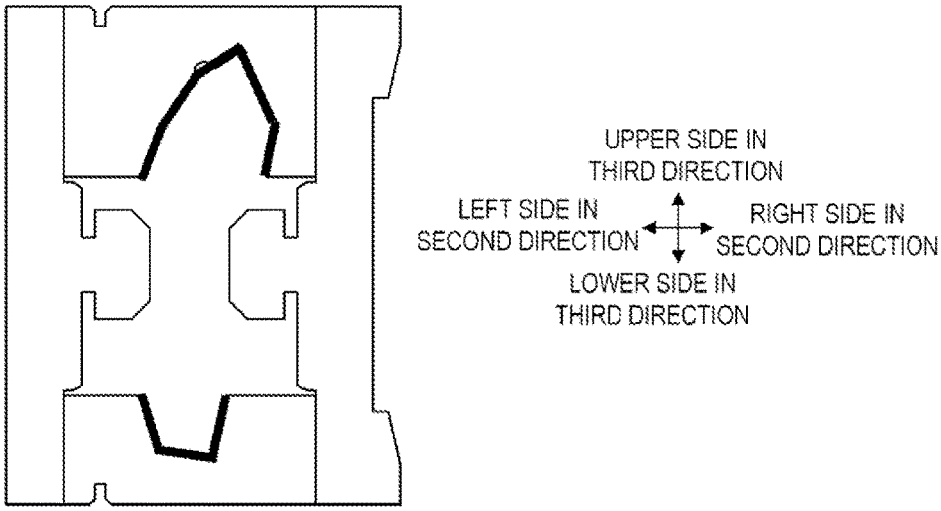
FIGS. 11A and 11B are diagrams illustrating a contact portion between the cartridge and a corrugated cardboard packing material.
Figure 11B:
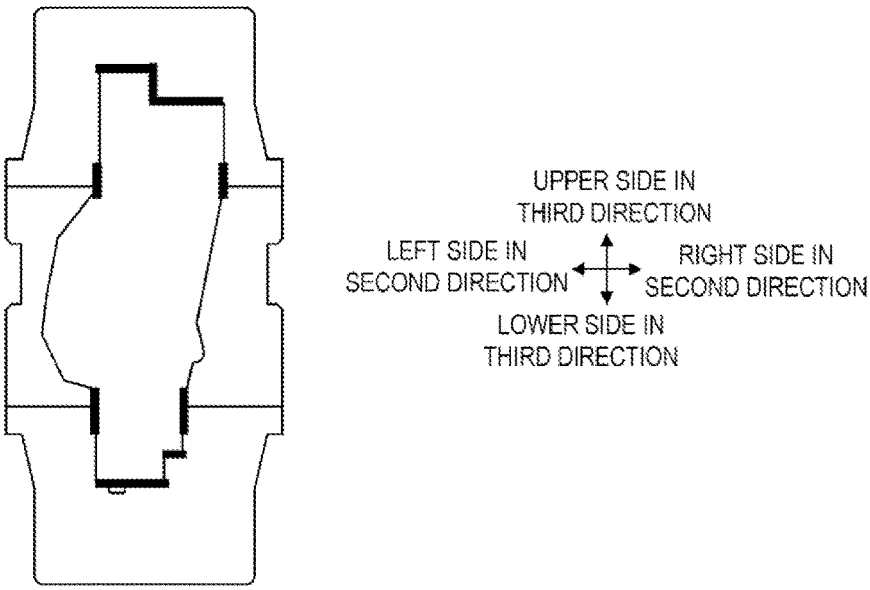

FIGS. 11A and 11B are diagrams illustrating a part where the cartridge D particularly comes into contact with the corrugated cardboard packing material 200 when the cartridge protection assembly is placed with the third direction up and down. FIG. 11A is an exploded view of the first member 300 in which a part of the corrugated cardboard packing material 200 where the cartridge D particularly comes into contact with the first member 300 is indicated by a thick line. FIG. 11B is an exploded view of the second member 301 in which a part of the corrugated cardboard packing material 200 where the cartridge D particularly comes into contact with the second member 301 is indicated by a thick line. Note that it is needless to say that a part which is not indicated by a thick line may come into contact with the cartridge D, depending on changes in the posture of the cartridge protection assembly, dimensional errors between the cartridge D and the corrugated cardboard packing material 200, changes in shape due to changes in the environment, and the like.

Figure 12A:
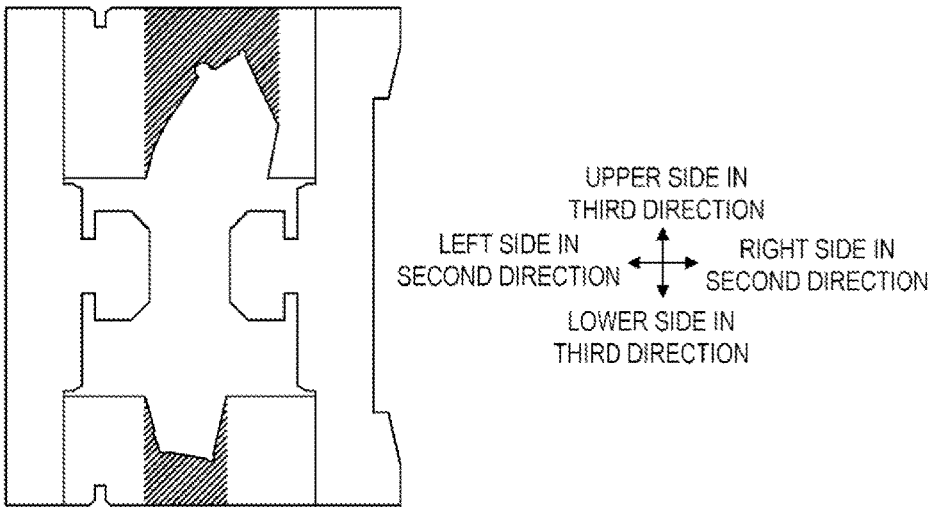
FIGS. 12A and 12B are diagrams illustrating a region that receives a drop impact in the corrugated cardboard packing material.
Figure 12B:
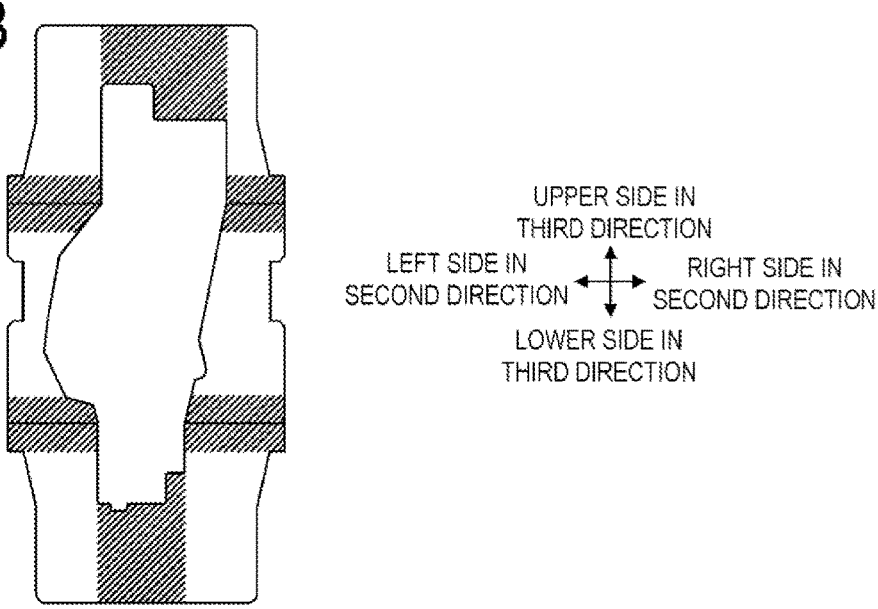

FIGS. 12A and 12B are diagrams illustrating a region of the corrugated cardboard packing material 200 which particularly receives a drop impact when the cartridge protection assembly is dropped in the third direction. FIG. 12A is an exploded view of the first member 300 in which a region of the first member 300 which particularly receives a drop impact in the corrugated cardboard packing material 200 is hatched. FIG. 12B is an exploded view of the second member 301 in which a region of the second member 301 which particularly receives a drop impact in the corrugated cardboard packing material 200 is hatched. Note that the hatched region are merely examples.

As illustrated in FIG. 12A, a region portion overlapping the concave-shaped edge 310*b* coming into contact with the cartridge D in the third direction in the upper base surface portion 310 of the first member 300 is a part that receives an impact when the cartridge protection assembly drops. In addition, as illustrated in FIG. 12A, a region portion overlapping the concave-shaped edge 311*b* coming into contact with the cartridge D in the third direction in the lower base surface portion 311 of the first member 300 is a part that receives an impact when the cartridge protection assembly drops. That is, in the first member 300, the upper base surface portion 310 and the lower base surface portion 311 are mainly portions that reduce an impact on an object to be packed (here, the cartridge D) when the cartridge protection assembly drops.

In addition, as illustrated in FIG. 12B, a region around the third folding line 522 between the second base surface portion 501 and the fifth protruding portion 324 of the second member 301 can be a part that receives an impact when the cartridge protection assembly drops. In addition, as illustrated in FIG. 12B, a region around the fourth folding line 523 between the second base surface portion 501 and the sixth protruding portion 325 of the second member 301 is also a part that receives an impact when the cartridge protection assembly drops. Further, as illustrated in FIG. 12B, a region that does not overlap the third folding line 522 in the first direction in the fifth protruding portion 324, and a region that does not overlap the fourth folding line 523 in the first direction in the sixth protruding portion 325 are also portions that receive an impact when the cartridge protection assembly drops. That is, these regions are portions of the second member 301 which reduce an impact on an object to be packed (here, the cartridge D) when the cartridge protection assembly drops.

Shock-Absorbing Property of Corrugated Cardboard Packing Material

Figure 7:
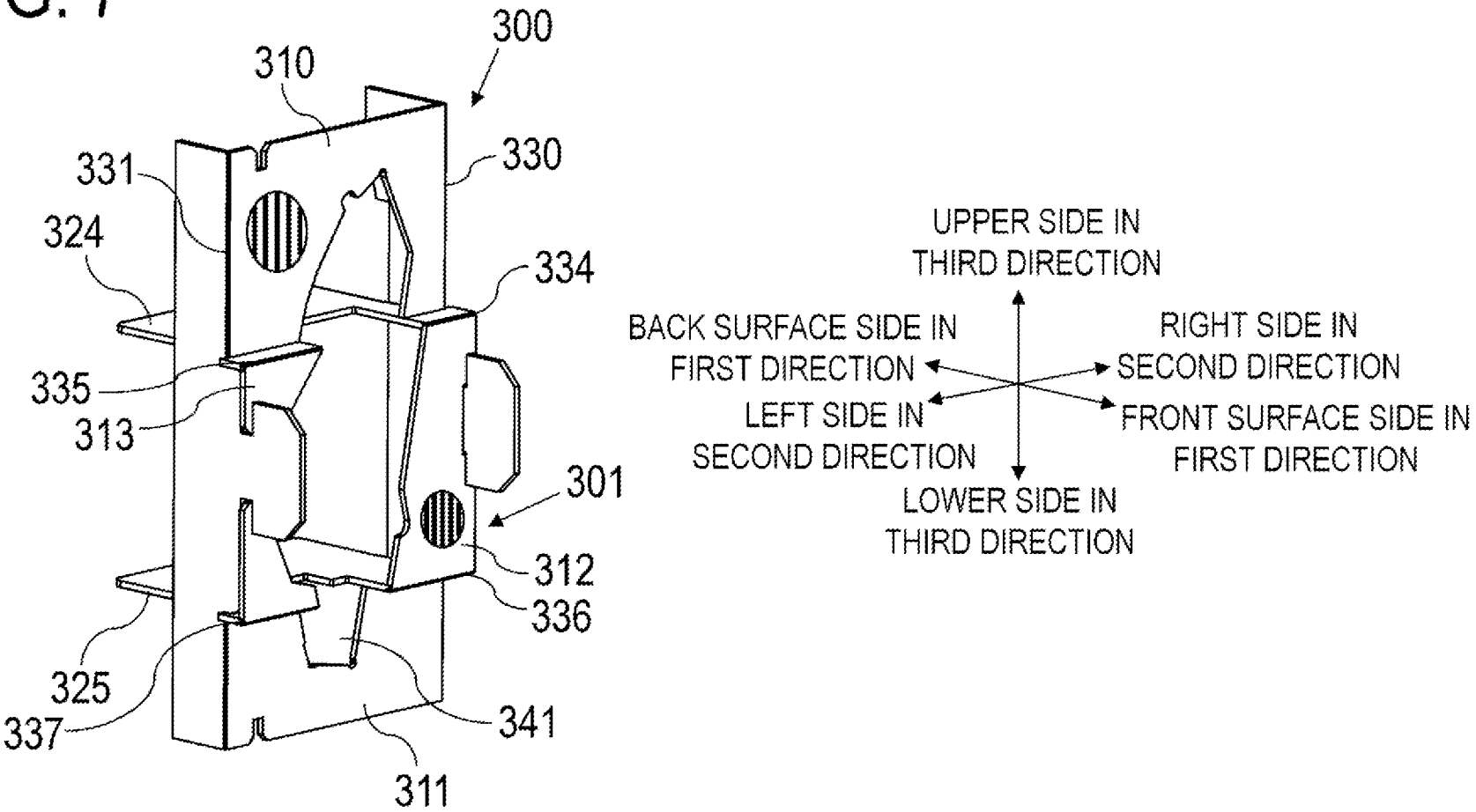
FIG. 7 is a perspective view illustrating a core direction of the first corrugated cardboard packing material.

The cushioning properties of the first corrugated cardboard packing material 200 will be described with reference to FIG. 7. FIG. 7 is a schematic perspective view of the first corrugated cardboard packing material 200 illustrating the direction of the corrugated cardboard core of the first corrugated cardboard packing material 200. The first corrugated cardboard packing material 200 and the second corrugated cardboard packing material 201 have a structure in which a center core formed into a waveform is sandwiched between a plurality of liners and bonded using glue or the like. The types of liner and flute are not particularly limited.

As illustrated in FIG. 7, the first member 300 is configured such that a flow direction, which is a direction in which the height of the waveform of the center core of the corrugated cardboard changes, is the second direction. Further, the second member 301 is configured such that the folding lines 330 and 332 as the first folding lines 520 and the folding lines 331 and 333 as the second folding lines 521 extend along the paper width direction perpendicular to the flow direction. In addition, the second member 301 is configured such that the flow direction in the second base surface portion 501 (the right base surface portion 312 and the left base surface portion 313) is the second direction. On the other hand, the second member 301 is configured such that the flow direction in the fifth protruding portion 324 and the sixth protruding portion 325 of the second member 301 is the first direction. The second member 301 is configured such that the folding lines 334 and 335 of the third folding line 522 and the folding lines 336 and 337 of the fourth folding line 523 extend in the flow direction.

When the corrugated cardboard absorbs vibration or drop impact, high rigidity is obtained in the paper width direction, and as illustrated in FIG. 7, high rigidity is obtained in the third direction and the first direction in the first corrugated cardboard packing material 200 of the present example.

The tip end portion 324*c* of the fifth protruding portion 324 as the first tip end portion 530 and the tip end portion 325*c* of the sixth protruding portion 325 as the second tip end portion 531 are portions that protrude the most in a direction toward the back surface side in the first direction in the cartridge protection assembly. Thus, in a case where the cartridge protection assembly drops toward the back surface side in the first direction, the tip end portion 324*c* and the tip end portion 325*c* first receive drop impact. The paper width direction in the fifth protruding portion 324 and the sixth protruding portion 325 coincides with the first direction, and thus, high rigidity can be exhibited in this case.

In addition, the upper base surface portion 310 and the lower base surface portion 311, which are first base surface portions 500, the first protruding portion 320, and the second protruding portion 321 are portions that are widest in the third direction in the cartridge protection assembly and protrude vertically more than other portions. Thus, in a case where vibration or drop impact is applied to the cartridge protection assembly in the third direction, the first base surface portions 500, the first protruding portion 320, and the second protruding portion 321 first receive the vibration or drop impact. The paper width direction in the first base surface portions 500, the first protruding portion 320, and the second protruding portion 321 coincides with the third direction. Further, the first base surface portion 500 and the first protruding portion 320, and the first base surface portion 500 and the second protruding portion 321 respectively form a substantially L-shaped structure when viewed in the first direction. Thus, the first corrugated cardboard packing material 200 can also exhibit the highest rigidity in the first direction.

Regarding the second direction that coincides with the flow direction of the corrugated cardboard core, in a case where vibration or drop impact occurs in the same direction, rigidity is lower than when vibration or drop occurs in the paper width direction. However, in this configuration, the rigidity is increased by providing the following substantially L-shaped structure in the second direction in which the rigidity of the corrugated cardboard is relatively low. That is, substantially an L shape formed by the right base surface portion 312 and the fifth protruding portion 324 along the folding line 334 and substantially an L shape formed by the left base surface portion 313 and the fifth protruding portion 324 along the folding line 335 are provided. In addition, substantially an L shape formed by the right base surface portion 312 and the sixth protruding portion 325 along the folding line 336 and substantially an L shape formed by the left base surface portion 313 and the sixth protruding portion 325 along the folding line 337 are provided.

On the right side in the second direction, the substantially L-shaped edge constituted by the right base surface portion 312 and the wide root portion of the fifth protruding portion 324, and the substantially L-shaped edge constituted by the right base surface portion 312 and the wide root portion of the sixth protruding portion 325 protrude to the rightmost side in the second direction in the cartridge protection assembly. In addition, on the left side in the second direction, the substantially L-shaped edge constituted by the left base surface portion 313 and the wide root portion of the fifth protruding portion 324, and the substantially L-shaped edge constituted by the left base surface portion 313 and the wide root portion of the sixth protruding portion 325 protrude to the leftmost side in the second direction in the cartridge protection assembly. Thus, in a case where vibration or drop impact occurs in the second direction, the vibration or drop impact is first received by these substantially L-shaped edges. That is, an impact is received in the direction of high rigidity in the substantially L-shaped structure.

A plate material such as a corrugated cardboard has a higher rigidity in the case of a structure bent in substantially an L shape than in the case of a flat plate-like structure as a whole. Higher rigidity makes it possible to absorb vibration and drop impact even when an object to be packed is heavy. Further, in this configuration, a cushioning portion having a cushioning property is interposed between an object to be packed and an object to which an impact is applied when vibration and impact are absorbed, and thus it is possible to obtain sufficient cushioning performance.

Modification Example 1

Figure 8A:
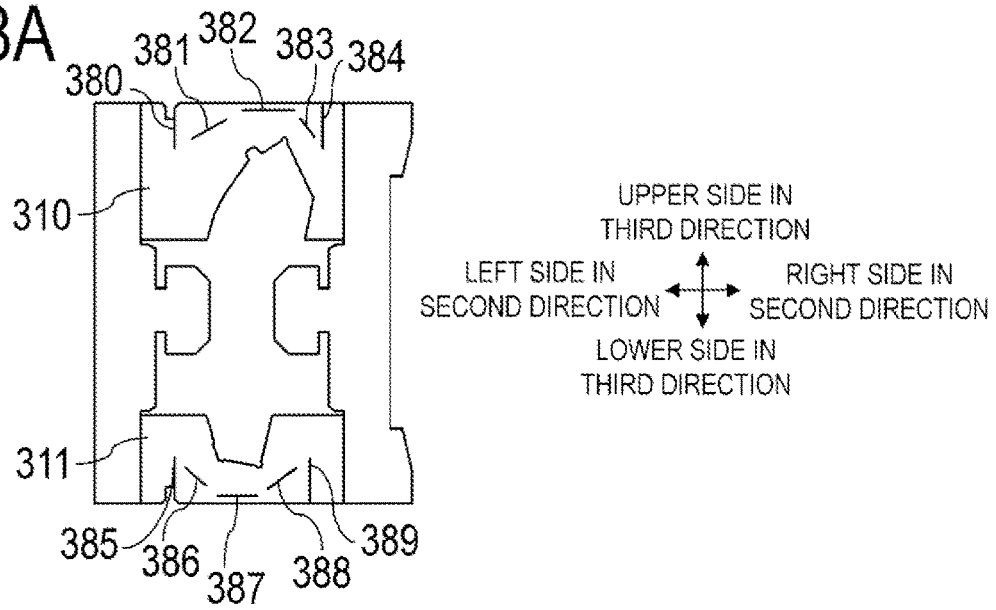
FIGS. 8A and 8B are exploded views of a configuration example in which cuts are provided in the first member and the second member.
Figure 8B:
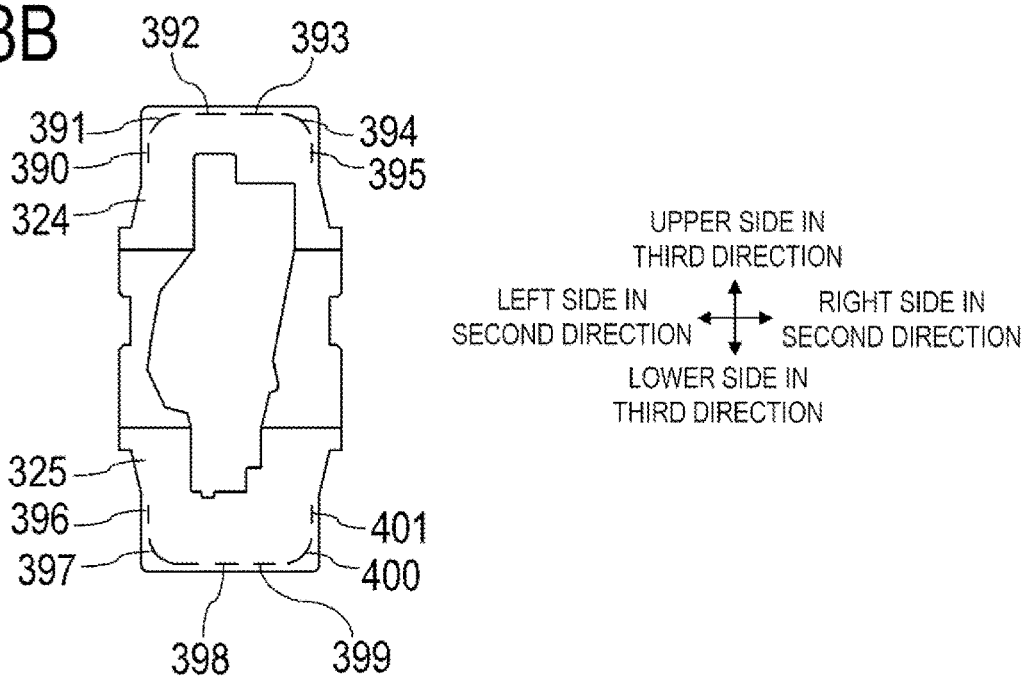

FIG. 8A is an exploded view of the first member 300 for describing cuts provided in the first member 300 as a modification example. FIG. 8B is an exploded view of the second member 301 for describing cuts provided in the second member 301 as a modification example. By providing the cuts, it is possible to locally form relatively soft portions in a corrugated cardboard packing material and to make crushing or folding occur from the cuts when vibration or drop impact occurs. That is, by providing the cuts, it is possible to control the degree of crushing or folding of the corrugated cardboard packing material due to vibration or drop impact.

As illustrated in FIG. 8A, the upper base surface portion 310 is provided with a cut 380 provided downward in the third direction from a position where the first positioning portion 370 is provided on the upper end in the third direction. Further, the upper base surface portion 310 is provided with a cut 384 provided downward in the third direction from a position which is substantially symmetrical to the cut 380 in the second direction at the upper end in the third direction. Further, the upper base surface portion 310 is provided with cuts 381 to 383 intermittently provided outside the concave-shaped edge 310*b* so as to substantially follow the edge 310*b*.

As illustrated in FIG. 8A, the lower base surface portion 311 is provided with a cut 385 provided upward in the third direction from a position where the second positioning portion 371 is provided at the lower end portion in the third direction. In addition, the lower base surface portion 311 is provided with a cut 389 provided upward in the third direction from a position substantially symmetrical to the cut 385 in the second direction at the lower end in the third direction. Further, the lower base surface portion 311 is provided with cuts 386 to 388 provided intermittently outside the concave-shaped edge 311*b* so as to substantially follow the edge 311*b*.

As illustrated in FIG. 8B, the fifth protruding portion 324 is provided with cuts 390, 391, 392, 393, 394, and 395 that are intermittently provided to substantially follow the outline shape of the tip end portion 324*c*. In addition, the sixth protruding portion 325 is provided with cuts 396, 397, 398, 399, 400, and 401 that are intermittently provided to substantially follow the outline shape on the tip end portion 325*c* side.

With the various cuts described above, it is possible to control the extent to which the upper base surface portion 310, the lower base surface portion 311, the fifth protruding portion 324, and the sixth protruding portion 325 are crushed due to vibration or drop impact. The number of cuts provided in the upper base surface portion 310, the lower base surface portion 311, the fifth protruding portion 324, and the sixth protruding portion 325 is not particularly limited, and a configuration in which five cuts are provided in the upper base surface portion 310, and no cut is provided in the lower base surface portion 311 may be adopted. In addition, a part to be provided with a cut is not limited to the upper base surface portion 310 and the lower base surface portion 311, and a cut may be provided in, for example, the right base surface portion 312 and the left base surface portion 313. That is, the positions, sizes, number, and the like of the cuts are arbitrary.

Modification Example 2

Figure 9:
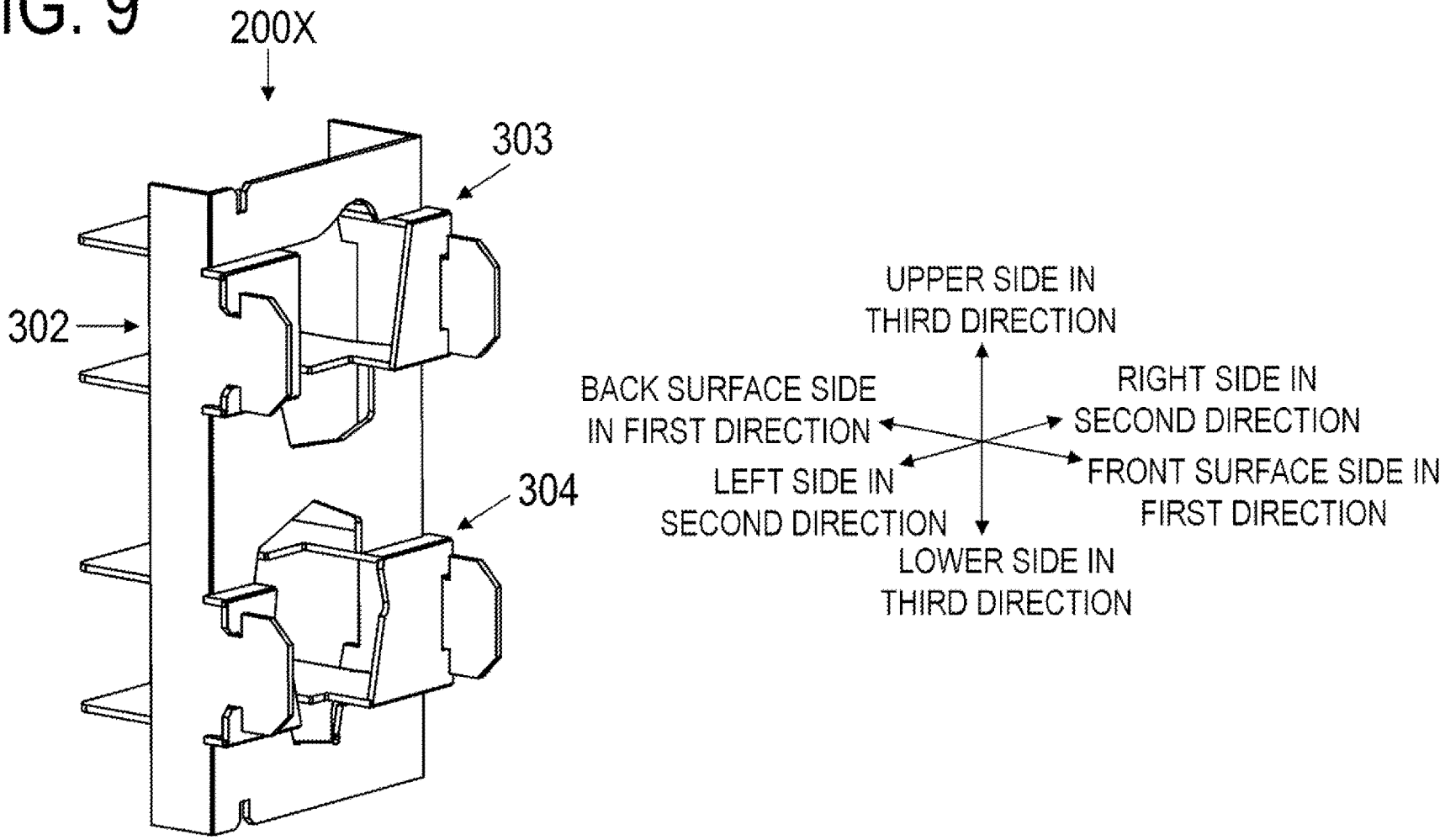
FIG. 9 is a perspective view of a first corrugated cardboard packing material constituted by three parts.

FIG. 9 is a schematic perspective view of a first corrugated cardboard packing material 200X constituted by three parts as a further modification example. The first corrugated cardboard packing material 200 does not necessarily need to be constituted by two parts, that is, the first member 300 and the second member 301. As illustrated in FIG. 9, the first corrugated cardboard packing material may be constituted by three parts, that is, a third member 302, a fourth member 303, and a fifth member 304. In addition, the first corrugated cardboard packing material may be constituted by four or more parts.

Others

In this example, a configuration in which the cartridge protection assembly is sandwiched between the first corrugated cardboard packing material 200 and the second corrugated cardboard packing material 201 from opposite longitudinal directions of the cartridge D has been adopted as a configuration of the cartridge protection assembly, but the present invention is not limited to such a configuration. For example, a configuration in which the corrugated cardboard packing material is mounted in only one of the longitudinal directions of the cartridge D and disposed with the longitudinal direction as a vertical direction, and the corrugated cardboard packing material is used like a tray may be adopted.

In addition, the first member 300 and the second member 301 do not need to be formed of the same material as the corrugated cardboard packing material, and the material and basis weight of each of the members can be changed appropriately.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-026416, filed on Feb. 24, 2022, which is hereby incorporated by reference herein in its entirety.

What is claimed is:

1. A packing member for packing an object to be packed, the packing member comprising:

a first member and a second member that are constituted by a corrugated cardboard plate, wherein the first member includes a first base surface portion that intersects a first direction, a first hole portion that penetrates the first base surface portion in the first direction, a first side surface portion that is provided at one end of the first base surface portion in a second direction intersecting the first direction and that is folded with respect to the first base surface portion along a first folding line extending in a third direction intersecting both the first direction and the second direction, and wherein the first side surface portion extends in the first direction away from the first folding line, and a second side surface portion that is provided at the other end of the first base surface portion in the second direction and that is folded to the same side as the first side surface portion with respect to the first base surface portion along a second folding line extending in the third direction, and wherein the second side surface portion extends in the first direction away from the second folding line, wherein the second member includes a second base surface portion that intersects the first direction, a second hole portion that penetrates the second base surface portion in the first direction, a third side surface portion that is provided at one end of the second base surface portion in the third direction and that is folded with respect to the second base surface portion along a third folding line extending in the second direction, and wherein the third side surface portion extends in the first direction away from the third folding line, a third hole portion that is continuous with the second hole portion and penetrates the third side surface portion in the third direction, a fourth side surface portion that is provided at the other end of the second base surface portion in the third direction and that is folded to the same side as the third side surface portion with respect to the second base surface portion along a fourth folding line extending in the second direction, and wherein the fourth side surface portion extends in the first direction away from the fourth folding line, and a fourth hole portion that is continuous with the second hole portion and penetrates the fourth side surface portion in the third direction, wherein the third side surface portion of the second member is folded to the same side as the first side surface portion of the first member in the first direction, and wherein the second member is coupled to the first member to be inserted into the first hole portion of the first member in the first direction so that the first base surface portion is positioned between the third folding line and a tip end of the third side surface portion in the first direction and is positioned between the fourth folding line and a tip end of the fourth side surface portion in the first direction.

2. The packing member according to claim 1, wherein the first member includes a first regulation portion that is positioned on a side opposite to the third side surface portion with respect to the second base surface portion of the second member and faces the second base surface portion in the first direction, and a second regulation portion that is positioned on the same side as the third side surface portion with respect to the second base surface portion of the second member and faces the second base surface portion in the first direction.

3. The packing member according to claim 1, wherein the first member includes a third regulation portion that is positioned on a side opposite to the fourth side surface portion with respect to the third side surface portion of the second member and faces the third side surface portion in the third direction, and a fourth regulation portion that is positioned on a side opposite to the third side surface portion with respect to the fourth side surface portion of the second member and faces the fourth side surface portion in the third direction.

4. The packing member according to claim 1, wherein the first member includes a first engaged portion that is provided on a side opposite to the first side surface portion with respect to the first base surface portion in the first direction, a second engaged portion that is provided on a side opposite to the second side surface portion with respect to the first base surface portion in the first direction, and wherein the second base surface portion of the second member includes a first engaging portion that engages with the first engaged portion in the third direction, and a second engaging portion that engages with the second engaged portion in the third direction.

5. The packing member according to claim 1, wherein the first hole portion has a shape corresponding to an outline shape of the packing member on both sides in the third direction.

6. The packing member according to claim 1, wherein each of the second hole portion, the third hole portion, and the fourth hole portion has a shape corresponding to an outline shape of the packing member.

7. The packing member according to claim 1, wherein the second direction is a flow direction which is a direction in which a height of a waveform of a center core of the corrugated cardboard plate in the first member changes.

8. The packing member according to claim 7, wherein the second direction is the flow direction of the center core of the corrugated cardboard plate in the second member.

9. The packing member according to claim 1, wherein the first base surface portion, the first side surface portion, and the second side surface portion protrude most in the packing member in the third direction.

10. The packing member according to claim 1, wherein the first base surface portion and the first side surface portion, and the first base surface portion and the second side surface portion each form a structure in which a cross-section of the corrugated cardboard plate has substantially an L shape in a case of being viewed in the third direction in the first member.

11. The packing member according to claim 1, wherein the third side surface portion and the fourth side surface portion protrude most in the packing member in a direction in which the third side surface portion and the fourth side surface portion extend from the second base surface portion.

12. The packing member according to claim 1, wherein the second base surface portion, the third side surface portion, and the fourth side surface portion protrude most in the packing member in the second direction.

13. The packing member according to claim 1, wherein the second base surface portion and the third side surface portion, and the second base surface portion and the fourth side surface portion each form a structure in which a cross-section of the corrugated cardboard plate has substantially an L shape in a case of being viewed in the second direction in the second member.

14. The packing member according to claim 1, wherein the object to be packed is a cartridge that is attachable/detachable to/from an image forming apparatus.

15. A cartridge assembly comprising:

a cartridge used in an image forming apparatus; and a packing member for packing the cartridge, the packing member including a first member and a second member that are constituted by a corrugated cardboard plate and being attached to the cartridge by inserting the cartridge in a first direction, wherein the first member includes a first base surface portion that intersects the first direction, a first hole portion that penetrates the first base surface portion in the first direction, a first side surface portion that is provided at one end of the first base surface portion in a second direction intersecting the first direction and that is folded to face the first direction with respect to the first base surface portion along a first folding line extending in a third direction intersecting both the first direction and the second direction, and wherein the first side surface portion extends in the first direction away from the first folding line, and a second side surface portion that is provided at the other end of the first base surface portion in the second direction and that is folded to the same side as the first side surface portion with respect to the first base surface portion along a second folding line extending in the third direction, and wherein the second side surface portion extends in the first direction away from the second folding line, wherein the second member includes a second base surface portion that intersects the first direction, a second hole portion that penetrates the second base surface portion in the first direction, a third side surface portion that is provided at one end of the second base surface portion in the third direction and that is folded with respect to the second base surface portion along a third folding line extending in the second direction, and wherein the third side surface portion extends in the first direction away from the third folding line, a third hole portion that is continuous with the second hole portion and penetrates the third side surface portion in the third direction, a fourth side surface portion that is provided at the other end of the second base surface portion in the third direction and that is folded to the same side as the third side surface portion with respect to the second base surface portion along a fourth folding line extending in the second direction, and wherein the fourth side surface portion extends in the first direction away from the fourth folding line, and a fourth hole portion that is continuous with the second hole portion and penetrates the fourth side surface portion in the third direction, wherein the third side surface portion of the second member is folded to the same side as the first side surface portion of the first member in the first direction, wherein the second member is coupled to the first member to be inserted into the first hole portion of the first member in the first direction so that the first base surface portion is positioned between the third folding line and a tip end of the third side surface portion in the first direction and is positioned between the fourth folding line and a tip end of the fourth side surface portion in the first direction, and wherein the first hole portion, the second hole portion, the third hole portion, and the fourth hole portion integrally form a supporting portion into which an end portion of the cartridge is able to be inserted in the first direction and which is able to support the end portion of the cartridge.

16. The cartridge assembly according to claim 15, wherein the packing member is configured to be able to support the end portion of the cartridge by an edge of the first base surface portion forming the first hole portion, an edge of the second base surface portion forming the second hole portion, an edge of the third side surface portion forming the third hole portion, and an edge of the fourth side surface portion forming the fourth hole portion.

* * * * *